US009707452B2

(12) United States Patent
Mimura et al.

(10) Patent No.: US 9,707,452 B2
(45) Date of Patent: Jul. 18, 2017

(54) GOLF BALL

(71) Applicant: DUNLOP SPORTS CO. LTD., Kobe-shi, Hyogo (JP)

(72) Inventors: Kohei Mimura, Kobe (JP); Takahiro Sajima, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 37 days.

(21) Appl. No.: 14/919,303

(22) Filed: Oct. 21, 2015

(65) Prior Publication Data

US 2016/0184645 A1 Jun. 30, 2016

(30) Foreign Application Priority Data

Dec. 26, 2014 (JP) ..... 2014-263950

(51) Int. Cl.
*A63B 37/14* (2006.01)
*A63B 37/00* (2006.01)

(52) U.S. Cl.
CPC ..... *A63B 37/0018* (2013.01); *A63B 37/002* (2013.01); *A63B 37/0006* (2013.01); *A63B 37/0017* (2013.01); *A63B 37/0021* (2013.01); *A63B 37/0016* (2013.01); *A63B 37/0019* (2013.01)

(58) Field of Classification Search
USPC ..... 473/378–385
See application file for complete search history.

(56) References Cited

U.S. PATENT DOCUMENTS

| | | | | |
|---|---|---|---|---|
| 6,454,668 | B2 * | 9/2002 | Kasashima | A63B 37/0004 473/351 |
| 6,719,647 | B2 * | 4/2004 | Sajima | A63B 37/0004 473/378 |
| 6,761,647 | B2 * | 7/2004 | Kasashima | A63B 37/0004 473/378 |
| 2007/0149321 | A1 | 6/2007 | Sajima | |
| 2007/0173354 | A1 | 7/2007 | Sajima | |
| 2009/0191982 | A1 | 7/2009 | Kim et al. | |
| 2012/0004053 | A1 | 1/2012 | Kim | |
| 2013/0196791 | A1 | 8/2013 | Sajima et al. | |

* cited by examiner

*Primary Examiner* — Alvin Hunter
(74) *Attorney, Agent, or Firm* — Birch, Stewart, Kolasch & Birch, LLP

(57) ABSTRACT

A golf ball has a large number of dimples 10 on a surface thereof. The dimples 10 include a plurality of small dimples 10S each having an area of less than 8.0 $mm^2$, and a plurality of large dimples 10L each having an area of equal to or greater than 8.0 $mm^2$. A ratio PS of a sum of areas of all the small dimples 10S to a surface area of a phantom sphere of the golf ball is less than 2.0%. The number NL of the large dimples 10L is equal to or greater than 250 but less than 450. The number NL of the large dimples 10L and a degree G of uniformity of areas of the large dimples 10L satisfy the following mathematical formula (II):

$$G<0.0032\cdot NL+0.26 \quad \text{(II)}.$$

11 Claims, 29 Drawing Sheets

GOLF BALL

This application claims priority on Patent Application No. 2014-263950 filed in JAPAN on Dec. 26, 2014. The entire contents of this Japanese Patent Application are hereby incorporated by reference.

BACKGROUND OF THE INVENTION

Field of the Invention

The present invention relates to golf balls.

Specifically, the present invention relates to improvement of flight performance of golf balls.

Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

There have been various proposals for dimples. US2009/0191982 (JP2009-172192) discloses a golf ball that has randomly arranged dimples. The dimple pattern of the golf ball is referred to as a random pattern. The random pattern can contribute to flight performance of the golf ball. US2012/0004053 (JP2012-10822) also discloses a golf ball having a random pattern.

US2007/0149321 (JP2007-175267) discloses a dimple pattern in which the number of units present in a high-latitude region is different from the number of units present in a low-latitude region. US2007/0173354 (JP2007-195591) discloses a dimple pattern in which the number of types of dimples present in a low-latitude region is greater than the number of types of dimples present in a high-latitude region. US2013/0196791 (JP2013-153966) discloses a dimple pattern in which the density of dimples is high and variations in sizes of dimples are small.

The greatest interest to golf players concerning golf balls is flight performance. Golf players desire golf balls having excellent flight performance. In light of flight performance, there is room for improvement in a dimple pattern.

An object of the present invention is to provide a golf ball having excellent flight performance.

SUMMARY OF THE INVENTION

A golf ball according to the present invention has a large number of dimples on a surface thereof. The dimples include a plurality of small dimples each having an area of smaller than 8.0 $mm^2$, and a plurality of large dimples each having an area of equal to or greater than 8.0 $mm^2$. A ratio PS of a sum of areas of all the small dimples to a surface area of a phantom sphere of the golf ball is less than 2.0%. The number NL of the large dimples is equal to or greater than 250 but less than 450. The number NL of the large dimples and a degree G of uniformity of areas ($mm^2$) of the large dimples satisfy the following mathematical formula (II).

$$G<0.0032\cdot NL+0.26 \quad \text{(II)}$$

The golf ball according to the present invention includes the small dimples. The small dimples suppress distortion of a dimple pattern. Since the ratio PS is less than 2.0%, the distribution of sizes of dimples is not considerably varied by the small dimples. Furthermore, in the golf ball, the large dimples contribute to turbulization. In the golf ball, a great flight distance can be obtained.

Preferably, the ratio PS is equal to or greater than 0.7%. Preferably, the number NS of the small dimples is equal to or greater than 6 but equal to or less than 20. Preferably, a ratio (NS/N) of the number NS of the small dimples to the total number N of the dimples is equal to or greater than 0.01 but equal to or less than 0.07.

Preferably, the number NL is equal to or greater than 290 but less than 380.

Preferably, each dimple has a depth of the deepest portion from a surface of the phantom sphere of equal to or greater than 0.10 mm but equal to or less than 0.65 mm.

Preferably, a total volume of the dimples is equal to or greater than 450 $mm^3$ but equal to or less than 750 $mm^3$.

Preferably, the golf ball satisfies the following mathematical formula (IV).

$$G<0.0032\cdot NL+0.11 \quad \text{(IV)}$$

Preferably, the golf ball satisfies the following mathematical formula (VI).

$$G<0.0032\cdot NL-0.04 \quad \text{(VI)}$$

Preferably, a ratio of a sum of areas of all the dimples to the surface area of the phantom sphere of the golf ball is equal to or greater than 80%.

DESCRIPTION OF THE PREFERRED EMBODIMENTS

The following will describe in detail the present invention, based on preferred embodiments with reference to the accompanying drawings.

Figure 1:
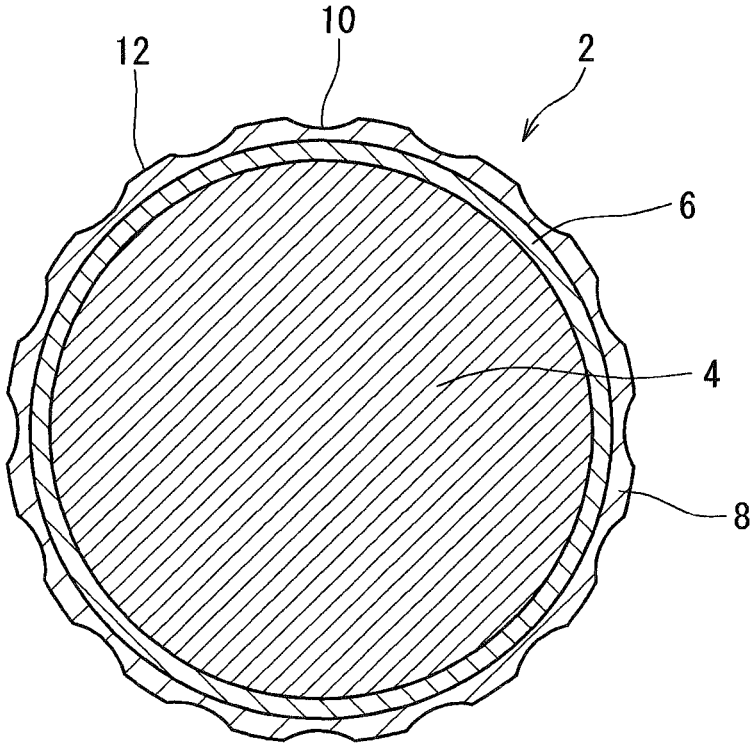
FIG. 1 is a cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. The golf ball 2 has a large number of dimples 10 on the surface thereof. Of the surface of the golf ball 2, a part other than the dimples 10 is a land 12. The golf ball 2 includes a paint layer and a mark layer on the external side of the cover 8 although these layers are not shown in the drawing.

The golf ball 2 has a diameter of preferably equal to or greater than 40 mm but equal to or less than 45 mm. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably equal to or greater than 40 g but equal to or less than 50 g. In light of attainment of great inertia, the weight is more preferably equal to or greater than 44 g and particularly preferably equal to or greater than 45.00 g. From the standpoint of conformity to the rules established by the USGA, the weight is particularly preferably equal to or less than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferred, and high-cis polybutadienes are particularly preferred.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, a dispersant and a carboxylate. The rubber composition may include synthetic resin powder or crosslinked rubber powder.

The core 4 has a diameter of preferably equal to or greater than 30.0 mm and particularly preferably equal to or greater than 38.0 mm. The diameter of core 4 is preferably equal to or less than 42.0 mm and particularly preferably equal to or less than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably equal to or greater than 0.2 mm and particularly preferably equal to or greater than 0.3 mm. The thickness of the mid layer 6 is preferably equal to or less than 2.5 mm and particularly preferably equal to or less than 2.2 mm. The mid layer 6 has a specific gravity of preferably equal to or greater than 0.90 and particularly preferably equal to or greater than 0.95. The specific gravity of the mid layer 6 is preferably equal to or less than 1.10 and particularly preferably equal to or less than 1.05. The mid layer 6 may have two or more layers.

The cover 8 is formed from a resin composition. A preferable base polymer of the resin composition is a polyurethane. The resin composition may include a thermoplastic polyurethane or may include a thermosetting polyurethane. In light of productivity, the thermoplastic polyurethane is preferred. The thermoplastic polyurethane includes a polyurethane component as a hard segment, and a polyester component or a polyether component as a soft segment.

The polyurethane has a urethane bond within the molecule. The urethane bond can be formed by reacting a polyol with a polyisocyanate. The polyol, as a material for the urethane bond, has a plurality of hydroxyl groups. Low-molecular-weight polyols and high-molecular-weight polyols can be used.

Examples of an isocyanate for the polyurethane component include alicyclic diisocyanates, aromatic diisocyanates, and aliphatic diisocyanates. Alicyclic diisocyanates are particularly preferred. Since an alicyclic diisocyanate does not have any double bond in the main chain, the alicyclic diisocyanate suppresses yellowing of the cover 8. Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Instead of a polyurethane, the resin composition of the cover 8 may include another polymer. Examples of the other polymer include ionomer resins, polystyrenes, polyamides, polyesters, and polyolefins. The resin composition may include two or more polymers.

The resin composition of the cover 8 may include a coloring agent such as titanium dioxide, a filler such as barium sulfate, a dispersant, an antioxidant, an ultraviolet absorber, a light stabilizer, a fluorescent material, a fluorescent brightener, and the like.

The cover 8 has a thickness of preferably equal to or greater than 0.2 mm and particularly preferably equal to or greater than 0.3 mm. The thickness of the cover 8 is preferably equal to or less than 2.5 mm and particularly preferably equal to or less than 2.2 mm. The cover 8 has a specific gravity of preferably equal to or greater than 0.90 and particularly preferably equal to or greater than 0.95. The specific gravity of the cover 8 is preferably equal to or less than 1.10 and particularly preferably equal to or less than 1.05. The cover 8 may have two or more layers.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. The reinforcing layer is formed from a polymer composition. Examples of the base polymer of the reinforcing layer include two-component curing type epoxy resins and two-component curing type urethane resins.

As shown in FIGS. 2 to 7, the contour of each dimple 10 is circular. The golf ball 2 has dimples A each having a diameter of 4.50 mm; dimples B each having a diameter of 4.40 mm; dimples C each having a diameter of 4.30 mm; dimples D each having a diameter of 4.20 mm; and dimples E each having a diameter of 3.00 mm. The number of types of the dimples 10 is five. The golf ball 2 may have non-circular dimples instead of the circular dimples 10 or together with the circular dimples 10.

The number of the dimples A is 80; the number of the dimples B is 74; the number of the dimples C is 62; the number of the dimples D is 96; and the number of the dimples E is 12. The total number of the dimples 10 is 324. A dimple pattern is formed by the dimples 10 and the land 12.

Figure 8:
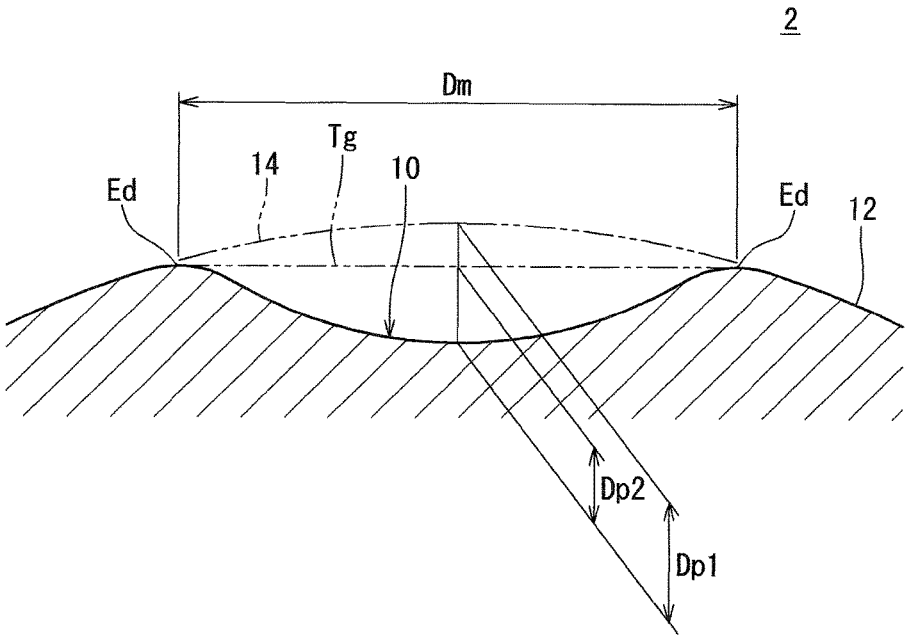
FIG. 8 is a partially enlarged cross-sectional view of the golf ball in FIG. 1.

FIG. 8 shows a cross section of the golf ball 2 along a plane passing through the center of the dimple 10 and the center of the golf ball 2. In FIG. 8, the top-to-bottom direction is the depth direction of the dimple 10. In FIG. 8, what is indicated by a chain double-dashed line 14 is a phantom sphere. The surface of the phantom sphere 14 is the surface of the golf ball 2 when it is postulated that no dimple 10 exists. The diameter of the phantom sphere 14 is the same as the diameter of the golf ball 2. The dimple 10 is recessed from the surface of the phantom sphere 14. The land 12 coincides with the surface of the phantom sphere 14. In the present embodiment, the cross-sectional shape of each dimple 10 is substantially a circular arc.

In FIG. 8, what is indicated by a double ended arrow Dm is the diameter of the dimple 10. The diameter Dm is a distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 8, what is indicated by a double ended arrow Dp1 is a first depth of the dimple 10. The first depth Dp1 is a distance between the deepest portion of the dimple 10 and the surface of the phantom sphere 14. In FIG. 8, what is indicated by a double ended arrow Dp2 is a second depth of the dimple 10. The second depth Dp2 is a distance between the deepest portion of the dimple 10 and the tangent line Tg.

The diameter Dm of each dimple 10 is preferably equal to or greater than 2.0 mm but equal to or less than 6.0 mm. The dimple 10 having a diameter Dm of equal to or greater than 2.0 mm contributes to turbulization. In this respect, the diameter Dm is more preferably equal to or greater than 2.5 mm and particularly preferably equal to or greater than 2.8 mm. The dimple 10 having a diameter Dm of equal to or less than 6.0 mm does not impair a fundamental feature of the golf ball 2 being substantially a sphere. In this respect, the diameter Dm is more preferably equal to or less than 5.5 mm and particularly preferably equal to or less than 5.0 mm.

In light of suppression of rising of the golf ball 2 during flight, the first depth Dp1 of each dimple 10 is preferably equal to or greater than 0.10 mm, more preferably equal to or greater than 0.13 mm, and particularly preferably equal to or greater than 0.15 mm. In light of suppression of dropping of the golf ball 2 during flight, the first depth Dp1 is preferably equal to or less than 0.65 mm, more preferably equal to or less than 060 mm, and particularly preferably equal to or less than 0.55 mm.

An area s of the dimple 10 is the area of a region surrounded by the contour line of the dimple 10 when the center of the golf ball 2 is viewed at infinity. In case of a circular dimple 10, the area S is calculated by the following formula.

$$S=(Dm/2)^2*\pi$$

In the golf ball 2 shown in FIGS. 2 to 7, the area of each dimple A is 15.9 $mm^2$; the area of each dimple B is 15.2 $mm^2$; the area of each dimple C is 14.5 $mm^2$; the area of each dimple D is 13.9 $mm^2$; and the area of each dimple E is 7.1 $mm^2$.

In the present invention, the ratio of the sum of the areas S of all the dimples 10 to the surface area of the phantom sphere 14 is referred to as an occupation ratio. From the standpoint that a sufficient turbulization can be obtained, the occupation ratio is preferably equal to or greater than 80%, more preferably equal to or greater than 81%, and particularly preferably equal to or greater than 82%. The occupation ratio is preferably equal to or less than 95%. In the golf ball 2 shown in FIGS. 2 to 7, the total area of the dimples 10 is 4712.8 $mm^2$. The surface area of the phantom sphere 14 of the golf ball 2 is 5728.0 $mm^2$, and thus the occupation ratio is 82.3%.

From the standpoint that a sufficient occupation ratio is achieved, the total number N of the dimples 10 is preferably equal to or greater than 250, more preferably equal to or greater than 280, and particularly preferably equal to or greater than 300. From the standpoint that each dimple 10 can contribute to turbulization, the total number N is preferably equal to or less than 450, more preferably equal to or less than 400, and particularly preferably equal to or less than 380.

In the present invention, the "volume of the dimple" means the volume of a portion surrounded by the surface of the phantom sphere 14 and the surface of the dimple 10. In light of suppression of rising of the golf ball 2 during flight, the total volume of the dimples 10 is preferably equal to or greater than 450 $mm^3$, more preferably equal to or greater than 480 $mm^3$, and particularly preferably equal to or greater than 500 $mm^3$. In light of suppression of dropping of the golf ball 2 during flight, the total volume is preferably equal to or less than 750 $mm^3$, more preferably equal to or less than 730 $mm^3$, and particularly preferably equal to or less than 710 $mm^3$.

In the present invention, a dimple 10 having an area of less than 8.0 $mm^2$ is referred to as a "small dimple 10S". In the golf ball 2 shown in FIGS. 2 to 7, the dimples E are the small dimples 10S. In the golf ball 2, the number NS of the small dimples 10S is 12.

In the present invention, a dimple 10 having an area of equal to or greater than 8.0 $mm^2$ is referred to as a "large dimple 10L". In the golf ball 2 shown in FIGS. 2 to 7, the dimples A to D are the large dimples 10L. In the golf ball 2, the number NL of the large dimples 10L is 312. The sum of the number NS and the number NL is equal to the total number N.

In a dimple pattern having only the large dimples 10L, the land 12 on the surface of the phantom sphere 14 tends to become mal-distributed. In the present specification, this mal-distribution is referred to as distortion. In the golf ball 2 according to the present invention, the small dimples 10S suppress the distortion. In the golf ball 2, the small dimples 10S facilitate turbulization. The flight distance of the golf ball 2 is great.

In a pattern in which the small dimples 10S are excessively present, variations in sizes of the dimples 10 are great. In the pattern having great variations, the turbulization is insufficient. A sufficient turbulization can be obtained in the golf ball 2 that has an appropriate number of the small dimples 10S. The flight distance of the golf ball 2 having an appropriate number of the small dimples 10S is great.

In light of flight distance, a ratio PS of the sum of areas of all the small dimples 10S to the surface area of the phantom sphere 14 is preferably equal to or greater than 0.7%, more preferably equal to or greater than 0.9%, and particularly preferably equal to or greater than 1.0%. In light of fight distance, the ratio PS is preferably less than 2.0%, more preferably equal to or less than 1.8%, and particularly preferably equal to or less than 1.7%. In the golf ball 2 shown in FIGS. 2 to 7, the ratio PS is 1.5%.

In light of flight distance, the number NS of the small dimples 10S is preferably equal to or greater than 6, more preferably equal to or greater than 8, and particularly preferably equal to or greater than 10. In light of flight distance, the number NS is preferably equal to or less than 20, more preferably equal to or less than 18, and particularly preferably equal to or less than 16.

In light of flight distance, a ratio (NS/N) of the number NS of the small dimples 10S to the total number N of the dimples 10 is preferably equal to or greater than 0.01, more preferably equal to or greater than 0.02, and particularly preferably equal to or greater than 0.03. In light of flight distance, the ratio (NS/N) is preferably equal to or less than 0.07, more preferably equal to or less than 0.06, and particularly preferably equal to or less than 0.05. In the golf ball 2 shown in FIGS. 2 to 7, the ratio (NS/N) is 0.04.

As already mentioned, in light of suppression of the distortion of the dimple pattern, the presence of the small dimples 10S is essential. Meanwhile, a degree of contribution of the small dimples 10S to turbulization is smaller than that of the large dimples 10L. A great occupation ratio can be attained in a dimple pattern in which the small dimples 10S are present in an appropriate number and the large dimples 10L are present in a sufficient number. The golf ball 2 having this dimple pattern is excellent in flight performance.

From the standpoint that a great occupation ratio is attained, the number NL of the large dimples 10L is preferably equal to or greater than 250, more preferably equal to or greater than 290, and particularly preferably equal to or greater than 310. From the standpoint that each large dimple 10L can contribute to turbulization, the number NL is preferably equal to or less than 450, more preferably equal to or less than 400, and particularly preferably equal to or less than 380.

In a pattern in which variations in sizes of the dimples are great, the turbulization is insufficient. From the standpoint that a sufficient turbulization can be obtained, a degree G of uniformity of areas of the large dimples 10L is preferably equal to or less than 1.15, more preferably equal to or less than 1.10, and particularly preferably equal to or less than 1.05.

The degree G of uniformity is a standard deviation of areas ($mm^2$) of the large dimples 10L. In the golf ball 2 shown in FIGS. 2 to 7, the average of areas of the large dimples 10L is 14.9 $mm^2$. The degree G of uniformity in the golf ball 2 is calculated based on the following mathematical formula.

$$G=(((15.9-14.9)^2*80+(15.2-14.9)^2*74+(14.5-14.9)^2*62+(13.9-14.9)^2*96)/312)^{1/2}$$

The degree G of uniformity in the golf ball 2 is 0.80.

Figure 29:
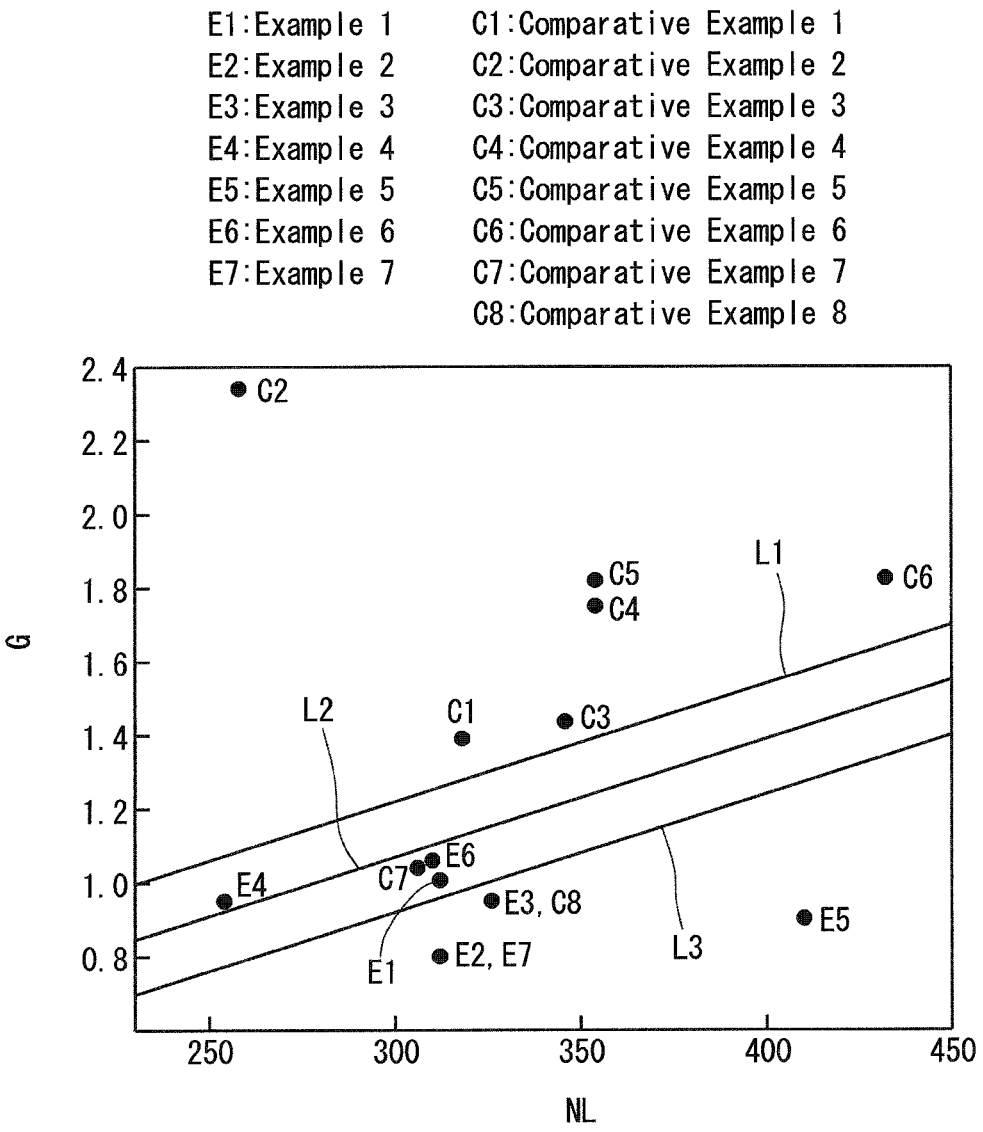
FIG. 29 is a graph in which golf balls according to Examples 1 to 7 and Comparative Examples 1 to 8 are plotted.

In the graph of FIG. 29, the horizontal axis represents the number NL of the large dimples 10L, and the vertical axis represents the degree G of uniformity of areas of the large dimples 10L. The straight line shown by the reference character L1 in the graph is expressed by the following mathematical formula (I).

$$G=0.0032\cdot NL+0.26 \quad \text{(I)}$$

In the graph of FIG. 29, a golf ball 2 included in a zone below the straight line L1 satisfies the following mathematical formula (II).

$$G<0.0032\cdot NL+0.26 \quad \text{(II)}$$

The golf ball 2 has small variations in areas of the large dimples 10L, considering the number NL of the large dimples 10L. The golf ball 2 has excellent flight performance.

The straight line shown by the reference character L2 in the graph of FIG. 29 is expressed by the following mathematical formula (III).

$$G=0.0032\cdot NL+0.11 \quad \text{(III)}$$

In the graph, a golf ball 2 included in a zone below the straight line L2 satisfies the following mathematical formula (IV).

$$G<0.0032\cdot NL+0.11 \quad \text{(IV)}$$

The golf ball 2 satisfying the formula (IV) has small variations in areas of the large dimples 10L, considering the number NL of the large dimples 10L. The golf ball 2 has excellent flight performance.

The straight line shown by the reference character L3 in the graph of FIG. 29 is expressed by the following mathematical formula (V).

$$G=0.0032\cdot NL-0.04 \quad \text{(V)}$$

In the graph, a golf ball 2 included in a zone below the straight line L3 satisfies the following mathematical formula (VI).

$$G<0.0032\cdot NL-0.04 \quad \text{(VI)}$$

The golf ball 2 satisfying the mathematical formula (VI) has small variations in areas of the large dimples 10L, considering the number NL of the large dimples 10L. The golf ball 2 has excellent flight performance.

EXAMPLES

Example 1

A rubber composition was obtained by kneading 100 parts by weight of a high-cis polybutadiene (trade name "BR-730", manufactured by JSR Corporation), 22.5 parts by weight of zinc diacrylate, 5 parts by weight of zinc oxide, 5 parts by weight of barium sulfate, 0.5 parts by weight of diphenyl disulfide, and 0.6 parts by weight of dicumyl peroxide. This rubber composition was placed into a mold including upper and lower mold halves each having a hemispherical cavity, and heated at 170° C. for 18 minutes to obtain a core with a diameter of 38.5 mm.

A resin composition was obtained by kneading 50 parts by weight of an ionomer resin (trade name "Himilan 1605", manufactured by Du Pont-MITSUI POLYCHEMICALS Co., Ltd.), 50 parts by weight of another ionomer resin ("Himilan AM7329", manufactured by Du Pont-MITSUI POLYCHEMICALS Co., Ltd.), and 4 parts by weight of titanium dioxide with a twin-screw kneading extruder. The core was covered with the resin composition by injection molding to form a mid layer with a thickness of 1.6 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition was obtained by kneading 100 parts by weight of a thermoplastic polyurethane elastomer (trade name "Elastollan XNY85A", manufactured by BASF Japan Ltd.) and 4 parts by weight of titanium dioxide with a twin-screw kneading extruder. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and having a large number of pimples on its cavity face, and a cover was obtained by compression molding. The thickness of the cover was 0.5 mm. Dimples having a shape that is the inverted shape of the pimples were formed on the cover. A clear paint including a two-component curing type polyurethane as a base material was applied to this cover to obtain a golf ball of Example 1 with a diameter of approximately 42.7 mm and a weight of approximately 45.6 g. The amount of compressive deformation of the golf ball in the case where a load was 98 N to 1274 N was 2.45 mm. The specifications of the dimples of the golf ball are shown in Table 1 below.

Examples 2 to 7 and Comparative Examples 1 to 8

Golf balls of Examples 2 to 7 and Comparative Examples 1 to 8 were obtained in the same manner as Example 1, except the specifications of the dimples were as shown in Tables 1 to 5 below. The dimple pattern of the golf ball according to Comparative Example 1 is the same as that of the golf ball according to Comparative Example 2 of JP2005-137692. The dimple pattern of the golf ball according to Comparative Example 2 is the same as that of the golf ball according to Comparative Example 4 of JP2006-20820. The dimple pattern of the golf ball according to Comparative Example 3 is the same as that of the golf ball according to Example 1 of JP2013-153966. The dimple pattern of the golf ball according to Comparative Example 4 is the same as that of the golf ball according to Example 4 of JP2005-137692. The dimple pattern of the golf ball according to Comparative Example 5 is the same as that of the golf ball according to Example 2 of JP2005-137692. The dimple pattern of the golf ball according to Comparative Example 6 is the same as that of the golf ball according to Comparative Example 3 of JP2005-137692.

A driver with a head made of a titanium alloy (trade name "SRIXON Z-TX", manufactured by DUNLOP SPORTS CO. LTD., shaft hardness: X, loft angle: 8.5°) was attached to a swing machine manufactured by Golf Laboratories, Inc. A golf ball was hit under the conditions of: a head speed of 50 m/sec; a launch angle of approximately 10°; and a backspin rate of approximately 2500 rpm, and the distance from the launch point to the stop point was measured. At the test, the weather was almost windless. The average value of data obtained by 20 measurements is shown in Tables 6 to 8 below.

TABLE 1

Specifications of Dimples

| | Number | Diameter (mm) | Dp2 (mm) | Dp1 (mm) | Curvature radius (mm) | Volume ($mm^3$) | Area ($mm^2$) |
|---|---|---|---|---|---|---|---|
| Example 1 | | | | | | | |
| A | 82 | 4.55 | 0.135 | 0.2566 | 19.24 | 2.079 | 16.3 |
| B | 42 | 4.50 | 0.135 | 0.2539 | 18.82 | 2.012 | 15.9 |
| C | 92 | 4.40 | 0.135 | 0.2487 | 17.99 | 1.884 | 15.2 |
| D | 34 | 4.30 | 0.135 | 0.2435 | 17.19 | 1.763 | 14.5 |
| E | 28 | 4.20 | 0.135 | 0.2385 | 16.40 | 1.648 | 13.9 |
| F | 34 | 4.05 | 0.135 | 0.2313 | 15.26 | 1.486 | 12.9 |
| G | 12 | 3.00 | 0.135 | 0.1878 | 8.40 | 0.663 | 7.1 |
| Example 2 | | | | | | | |
| A | 80 | 4.50 | 0.135 | 0.2539 | 18.82 | 2.012 | 15.9 |
| B | 74 | 4.40 | 0.135 | 0.2487 | 17.99 | 1.884 | 15.2 |
| C | 62 | 4.30 | 0.135 | 0.2435 | 17.19 | 1.763 | 14.5 |
| D | 96 | 4.20 | 0.135 | 0.2385 | 16.40 | 1.648 | 13.9 |
| E | 12 | 3.00 | 0.135 | 0.1878 | 8.40 | 0.663 | 7.1 |
| Example 3 | | | | | | | |
| A | 60 | 4.40 | 0.135 | 0.2487 | 17.99 | 1.884 | 15.2 |
| B | 158 | 4.30 | 0.135 | 0.2435 | 17.19 | 1.763 | 14.5 |
| C | 72 | 4.15 | 0.135 | 0.2361 | 16.01 | 1.592 | 13.5 |
| D | 36 | 3.90 | 0.135 | 0.2242 | 14.15 | 1.336 | 11.9 |
| E | 12 | 3.00 | 0.135 | 0.1878 | 8.40 | 0.663 | 7.1 |
| Example 4 | | | | | | | |
| A | 156 | 4.91 | 0.135 | 0.2766 | 22.39 | 2.609 | 18.9 |
| B | 98 | 4.65 | 0.135 | 0.2620 | 20.09 | 2.217 | 17.0 |
| C | 12 | 3.00 | 0.135 | 0.1878 | 8.40 | 0.663 | 7.1 |

TABLE 2

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Example 5 | | | | | | | |
| A | 70 | 4.10 | 0.135 | 0.2336 | 15.63 | 1.538 | 13.2 |
| B | 30 | 3.90 | 0.135 | 0.2242 | 14.15 | 1.336 | 11.9 |
| C | 120 | 3.80 | 0.135 | 0.2197 | 13.44 | 1.243 | 11.3 |
| D | 170 | 3.70 | 0.135 | 0.2153 | 12.74 | 1.155 | 10.8 |
| E | 20 | 3.60 | 0.135 | 0.2110 | 12.07 | 1.072 | 10.2 |
| F | 12 | 2.50 | 0.135 | 0.1716 | 5.85 | 0.422 | 4.9 |
| Example 6 | | | | | | | |
| A | 82 | 4.55 | 0.135 | 0.2566 | 19.24 | 2.079 | 16.3 |
| B | 42 | 4.50 | 0.135 | 0.2539 | 18.82 | 2.012 | 15.9 |
| C | 92 | 4.40 | 0.135 | 0.2487 | 17.99 | 1.884 | 15.2 |
| D | 34 | 4.30 | 0.135 | 0.2435 | 17.19 | 1.763 | 14.5 |
| E | 28 | 4.20 | 0.135 | 0.2385 | 16.40 | 1.648 | 13.9 |
| F | 32 | 4.05 | 0.135 | 0.2313 | 15.26 | 1.486 | 12.9 |
| G | 14 | 3.10 | 0.135 | 0.1913 | 8.97 | 0.721 | 7.5 |
| Example 7 | | | | | | | |
| A | 80 | 4.50 | 0.135 | 0.2539 | 18.82 | 2.012 | 15.9 |
| B | 74 | 4.40 | 0.135 | 0.2487 | 17.99 | 1.884 | 15.2 |
| C | 62 | 4.30 | 0.135 | 0.2435 | 17.19 | 1.763 | 14.5 |
| D | 96 | 4.20 | 0.135 | 0.2385 | 16.40 | 1.648 | 13.9 |
| E | 12 | 2.00 | 0.135 | 0.1584 | 3.77 | 0.250 | 3.1 |

TABLE 3

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Comparative Example 1 | | | | | | | |
| A | 42 | 4.35 | 0.160 | 0.2711 | 14.86 | 2.009 | 14.9 |
| B | 66 | 4.15 | 0.160 | 0.2611 | 13.54 | 1.762 | 13.5 |
| C | 72 | 3.95 | 0.155 | 0.2465 | 12.66 | 1.508 | 12.3 |
| D | 126 | 3.75 | 0.151 | 0.2335 | 11.72 | 1.287 | 11.0 |
| E | 12 | 3.65 | 0.150 | 0.2281 | 11.18 | 1.192 | 10.5 |
| F | 3 | 2.50 | 0.150 | 0.1866 | 5.28 | 0.459 | 4.9 |
| G | 12 | 2.40 | 0.150 | 0.1838 | 4.88 | 0.417 | 4.5 |
| Comparative Example 2 | | | | | | | |
| A | 132 | 4.95 | 0.137 | 0.2809 | 22.42 | 2.693 | 19.2 |
| B | 78 | 4.50 | 0.139 | 0.2579 | 18.28 | 2.044 | 15.9 |
| C | 36 | 4.20 | 0.137 | 0.2405 | 16.16 | 1.661 | 13.9 |
| D | 12 | 3.90 | 0.132 | 0.2212 | 14.47 | 1.318 | 11.9 |
| E | 12 | 3.10 | 0.130 | 0.1863 | 9.31 | 0.702 | 7.5 |
| Comparative Example 3 | | | | | | | |
| A | 16 | 4.60 | 0.135 | 0.2592 | 19.66 | 2.147 | 16.6 |
| B | 30 | 4.50 | 0.135 | 0.2539 | 18.82 | 2.012 | 15.9 |
| C | 30 | 4.40 | 0.135 | 0.2487 | 17.99 | 1.884 | 15.2 |
| D | 150 | 4.30 | 0.135 | 0.2435 | 17.19 | 1.763 | 14.5 |
| E | 30 | 4.20 | 0.135 | 0.2385 | 16.40 | 1.648 | 13.9 |
| F | 66 | 4.10 | 0.135 | 0.2336 | 15.63 | 1.538 | 13.2 |
| G | 10 | 3.80 | 0.135 | 0.2197 | 13.44 | 1.243 | 11.3 |
| H | 12 | 3.40 | 0.135 | 0.2028 | 10.77 | 0.919 | 9.1 |

TABLE 4

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Comparative Example 4 | | | | | | | |
| A | 66 | 4.40 | 0.140 | 0.2537 | 17.36 | 1.923 | 15.2 |
| B | 24 | 4.20 | 0.140 | 0.2435 | 15.82 | 1.682 | 13.9 |
| C | 60 | 4.10 | 0.140 | 0.2386 | 15.08 | 1.571 | 13.2 |
| D | 132 | 3.90 | 0.138 | 0.2272 | 13.85 | 1.354 | 11.9 |
| E | 72 | 3.55 | 0.130 | 0.2039 | 12.18 | 1.007 | 9.9 |
| F | 18 | 2.40 | 0.125 | 0.1588 | 5.82 | 0.359 | 4.5 |
| Comparative Example 5 | | | | | | | |
| A | 66 | 4.55 | 0.135 | 0.2566 | 19.24 | 2.079 | 16.3 |
| B | 24 | 4.35 | 0.130 | 0.2411 | 18.26 | 1.786 | 14.9 |
| C | 60 | 4.25 | 0.125 | 0.2310 | 18.13 | 1.633 | 14.2 |
| D | 132 | 4.05 | 0.125 | 0.2213 | 16.47 | 1.421 | 12.9 |
| E | 72 | 3.70 | 0.125 | 0.2053 | 13.75 | 1.101 | 10.8 |
| F | 18 | 2.55 | 0.125 | 0.1631 | 6.57 | 0.417 | 5.1 |
| Comparative Example 6 | | | | | | | |
| A | 132 | 4.10 | 0.141 | 0.2396 | 14.97 | 1.538 | 13.2 |
| B | 180 | 3.55 | 0.132 | 0.2059 | 12.00 | 1.032 | 9.9 |
| C | 60 | 3.40 | 0.132 | 0.1998 | 11.01 | 0.919 | 9.1 |
| D | 60 | 3.25 | 0.133 | 0.1949 | 9.99 | 0.816 | 8.3 |

TABLE 5

| Specifications of Dimples | | | | | | | |
|---|---|---|---|---|---|---|---|
| | Number | Diameter (mm) | Dp2 (mm) | Dp1 (mm) | Curvature radius (mm) | Volume ($mm^3$) | Area ($mm^2$) |
| Comparative Example 7 | | | | | | | |
| A | 82 | 4.55 | 0.135 | 0.2566 | 19.24 | 2.079 | 16.3 |
| B | 42 | 4.50 | 0.135 | 0.2539 | 18.82 | 2.012 | 15.9 |
| C | 92 | 4.40 | 0.135 | 0.2487 | 17.99 | 1.884 | 15.2 |
| D | 34 | 4.30 | 0.135 | 0.2435 | 17.19 | 1.763 | 14.5 |
| E | 28 | 4.20 | 0.135 | 0.2385 | 16.40 | 1.648 | 13.9 |
| F | 28 | 4.05 | 0.135 | 0.2313 | 15.26 | 1.486 | 12.9 |
| G | 18 | 3.00 | 0.135 | 0.1878 | 8.40 | 0.663 | 7.1 |
| Comparative Example 8 | | | | | | | |
| A | 60 | 4.40 | 0.135 | 0.2487 | 17.99 | 1.884 | 15.2 |
| B | 158 | 4.30 | 0.135 | 0.2435 | 17.19 | 1.763 | 14.5 |
| C | 72 | 4.15 | 0.135 | 0.2361 | 16.01 | 1.592 | 13.5 |
| D | 36 | 3.90 | 0.135 | 0.2242 | 14.15 | 1.336 | 11.9 |

TABLE 6

Figure 2:
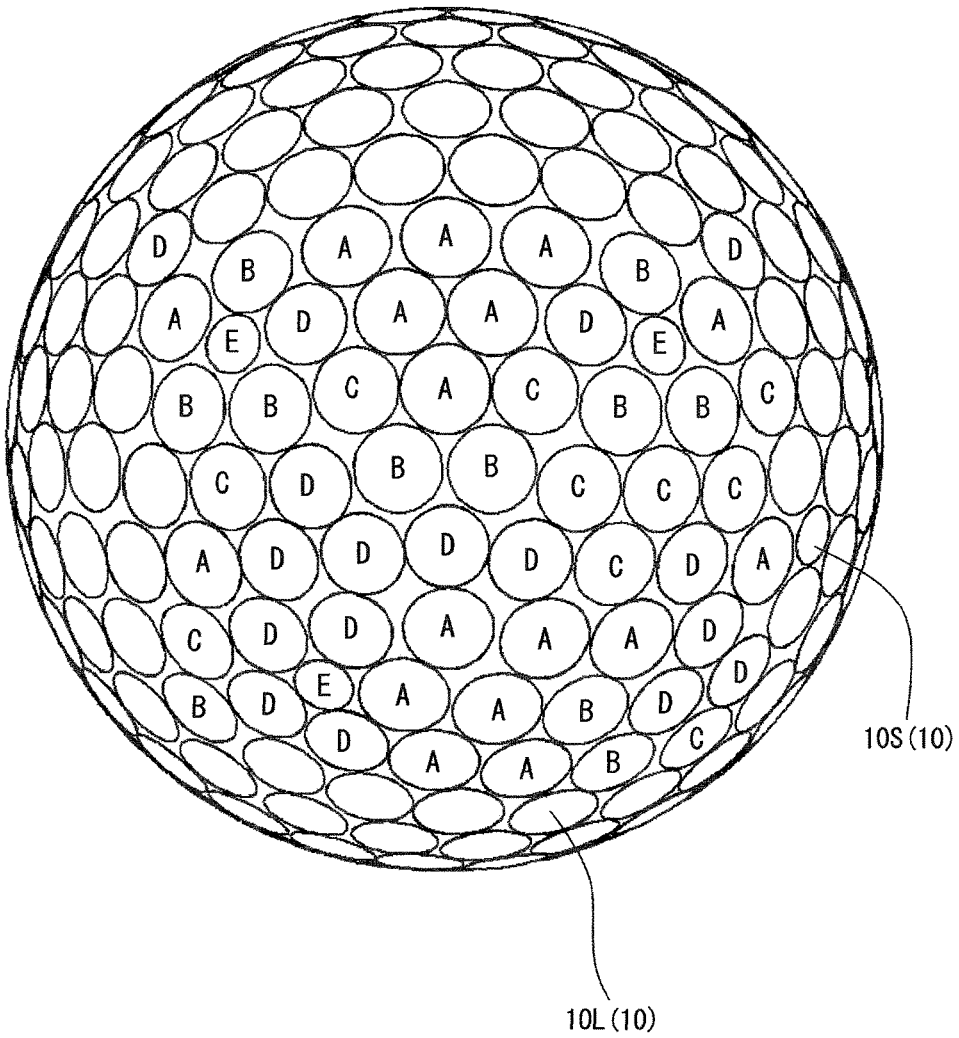
FIG. 2 is an enlarged front view of the golf ball in FIG. 1.
Figure 3:
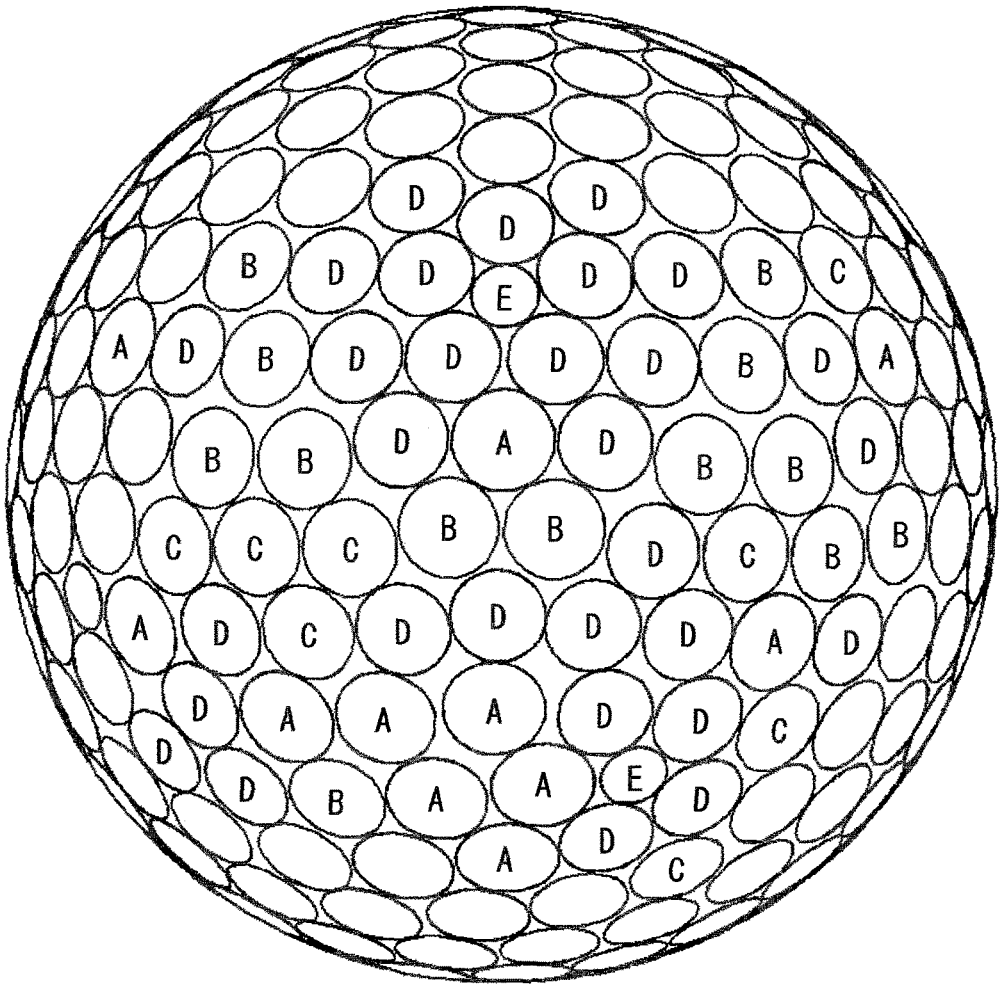
FIG. 3 is a back view of the golf ball in FIG. 2.
Figure 4:
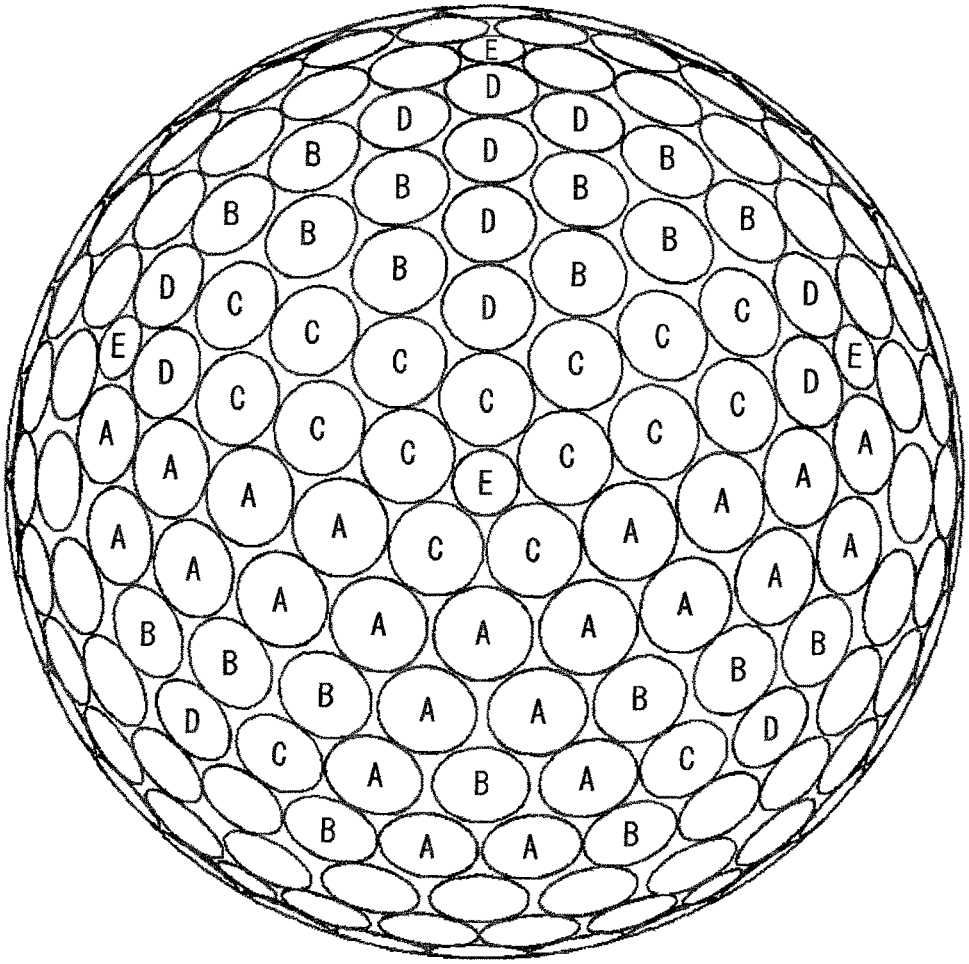
FIG. 4 is a plan view of the golf ball in FIG. 2.
Figure 5:
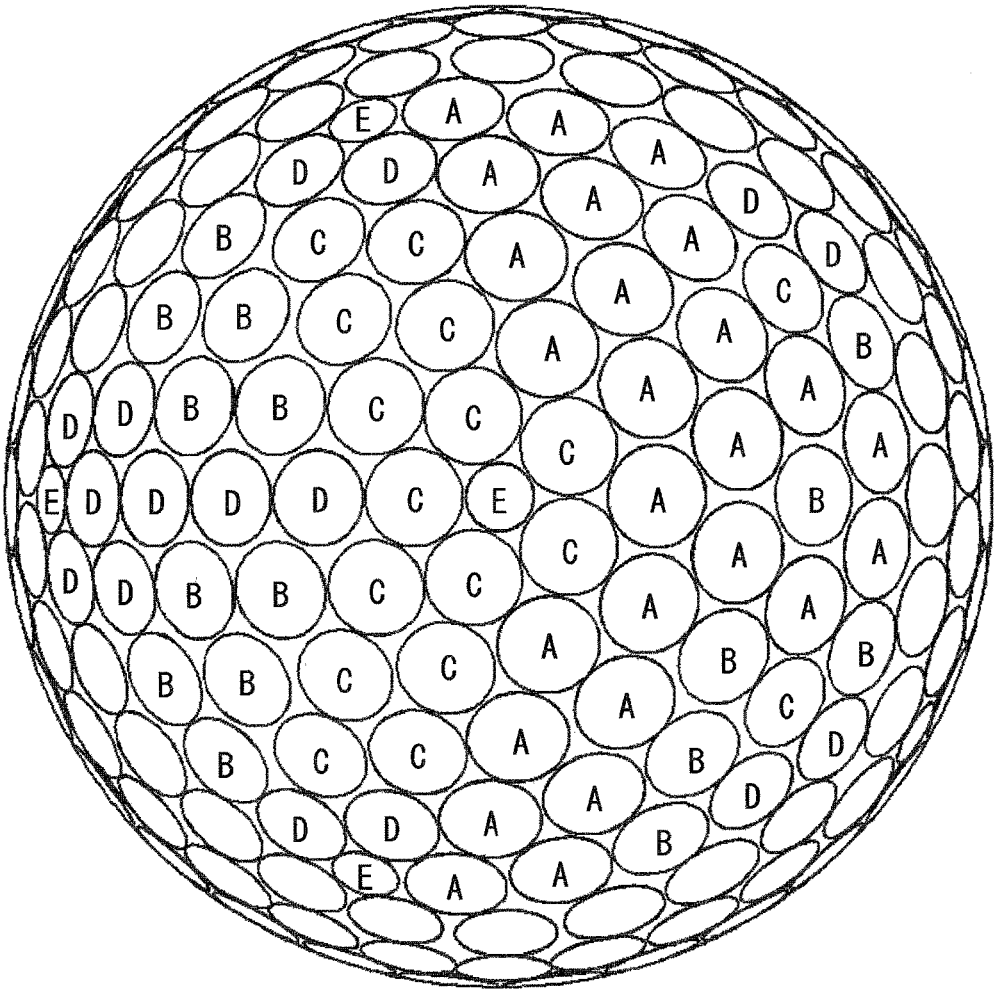
FIG. 5 is a bottom view of the golf ball in FIG. 2.
Figure 6:
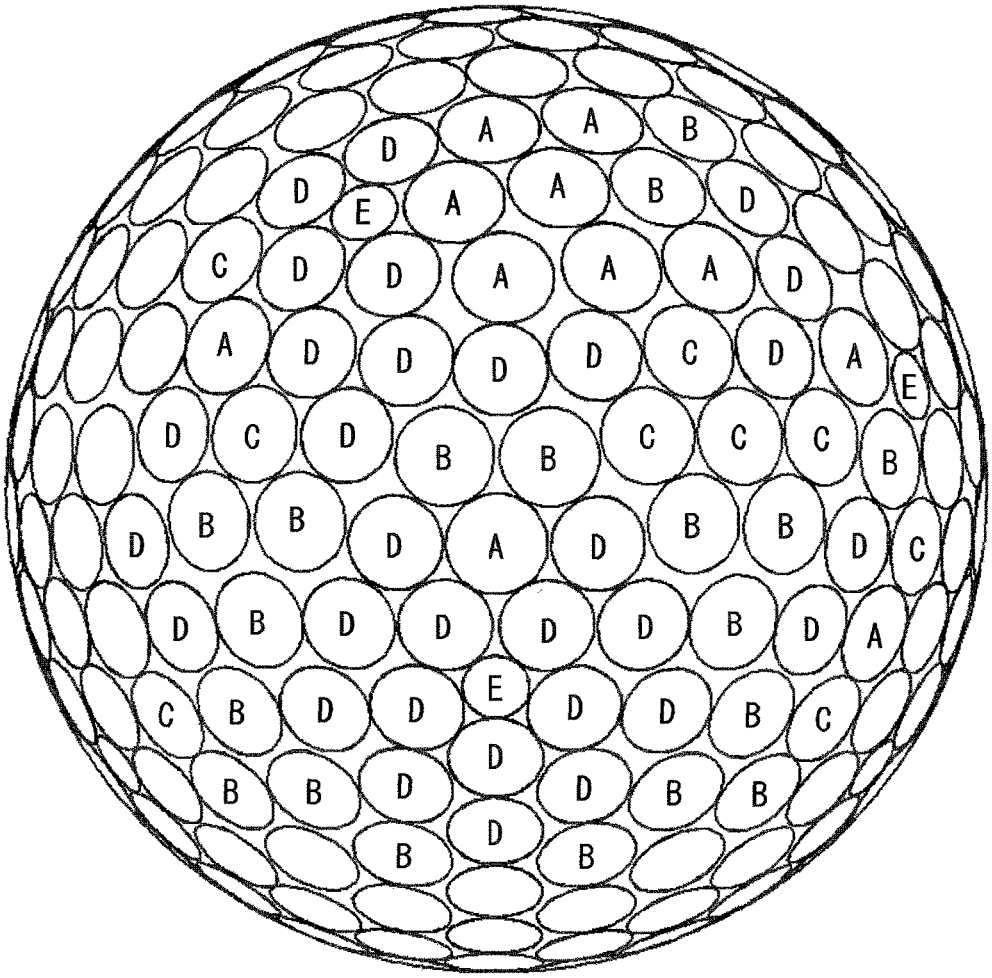
FIG. 6 is a left side view of the golf ball in FIG. 2.
Figure 7:
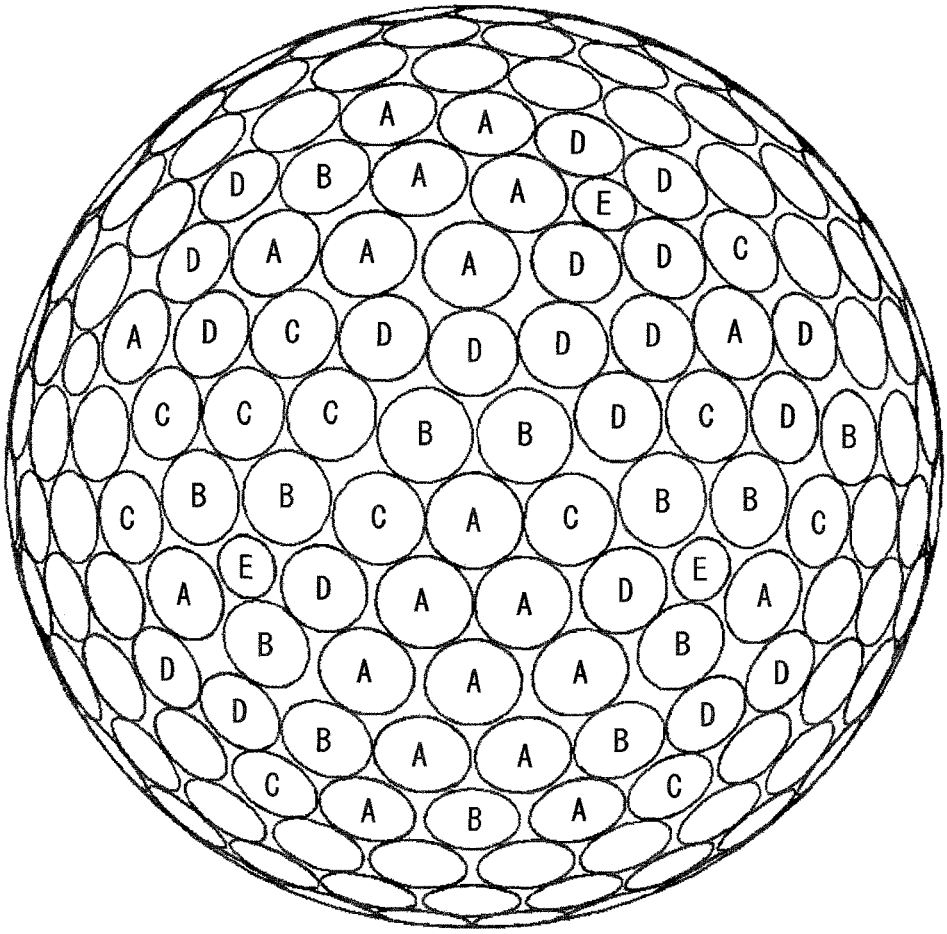
FIG. 7 is a right side view of the golf ball in FIG. 2.
Figure 9:
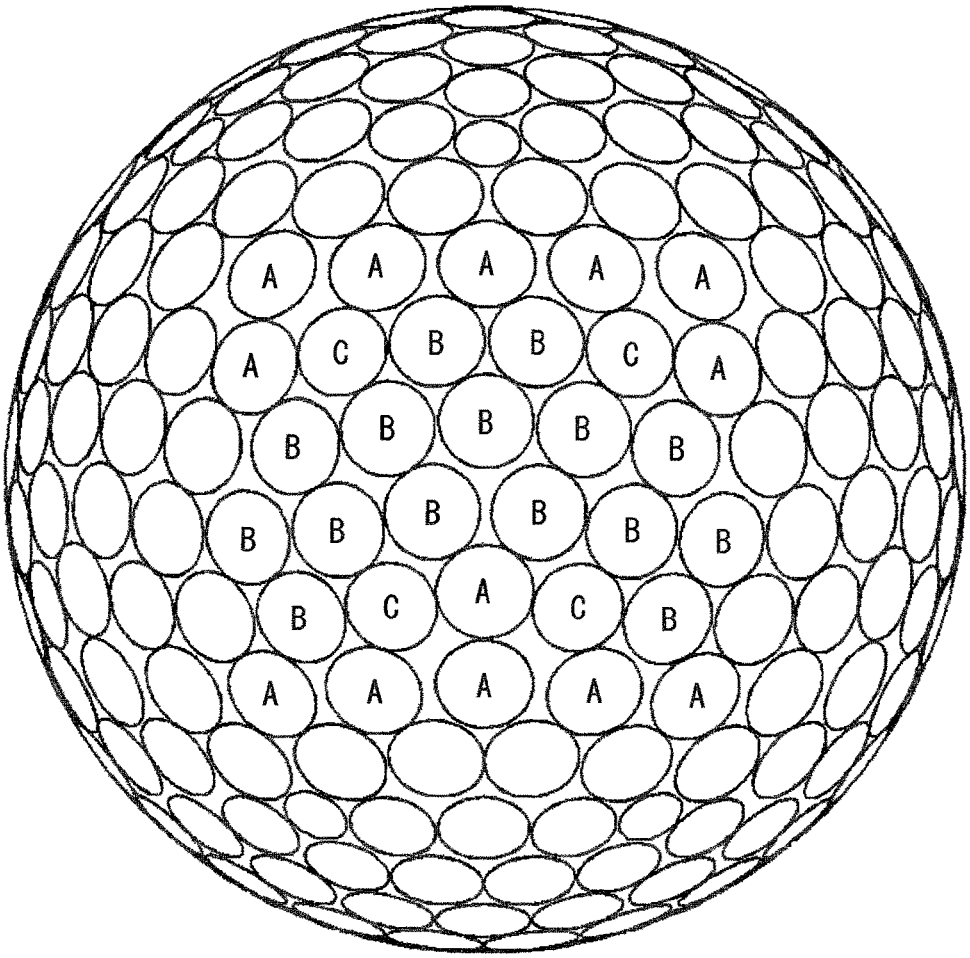
FIG. 9 is a front view of a golf ball according to Example 3 of the present invention.
Figure 10:
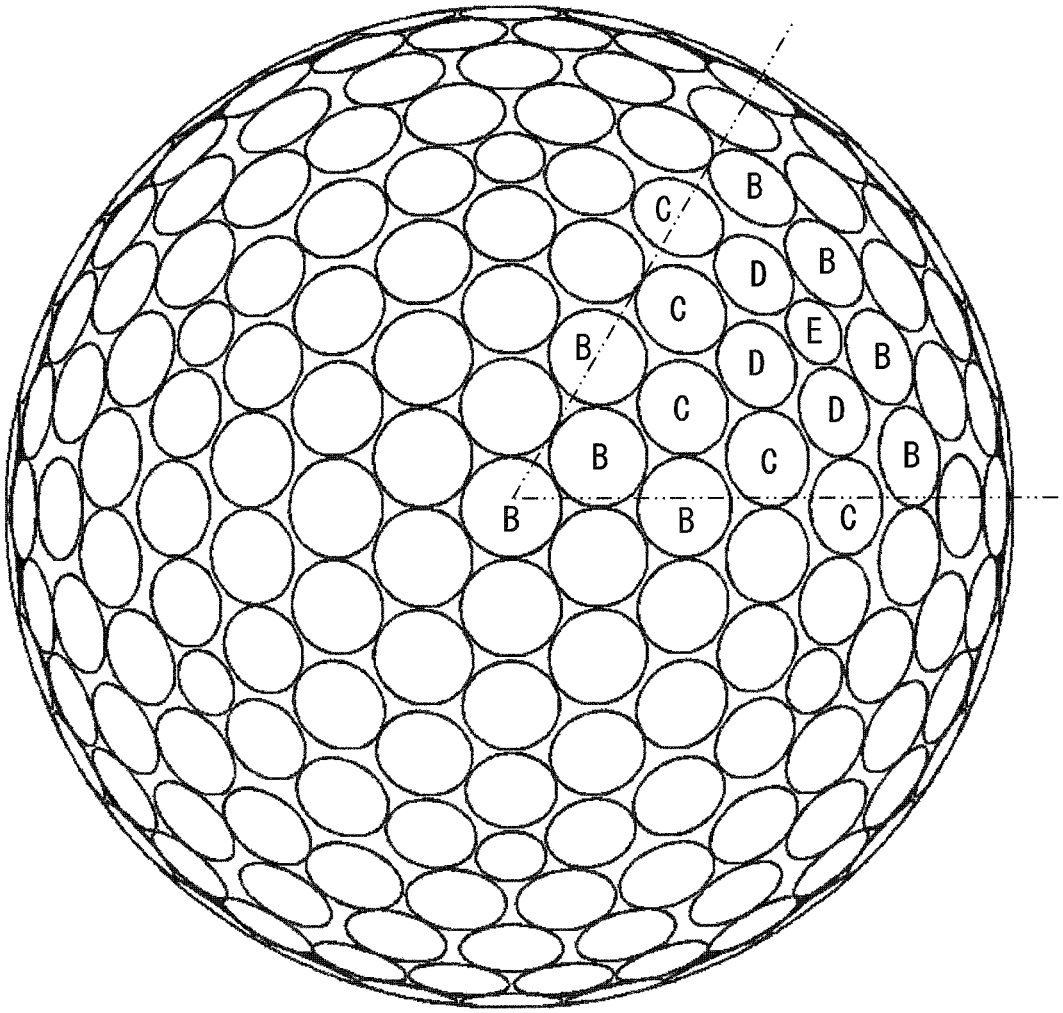
FIG. 10 is a plan view of the golf ball in FIG. 9.
Figure 11:
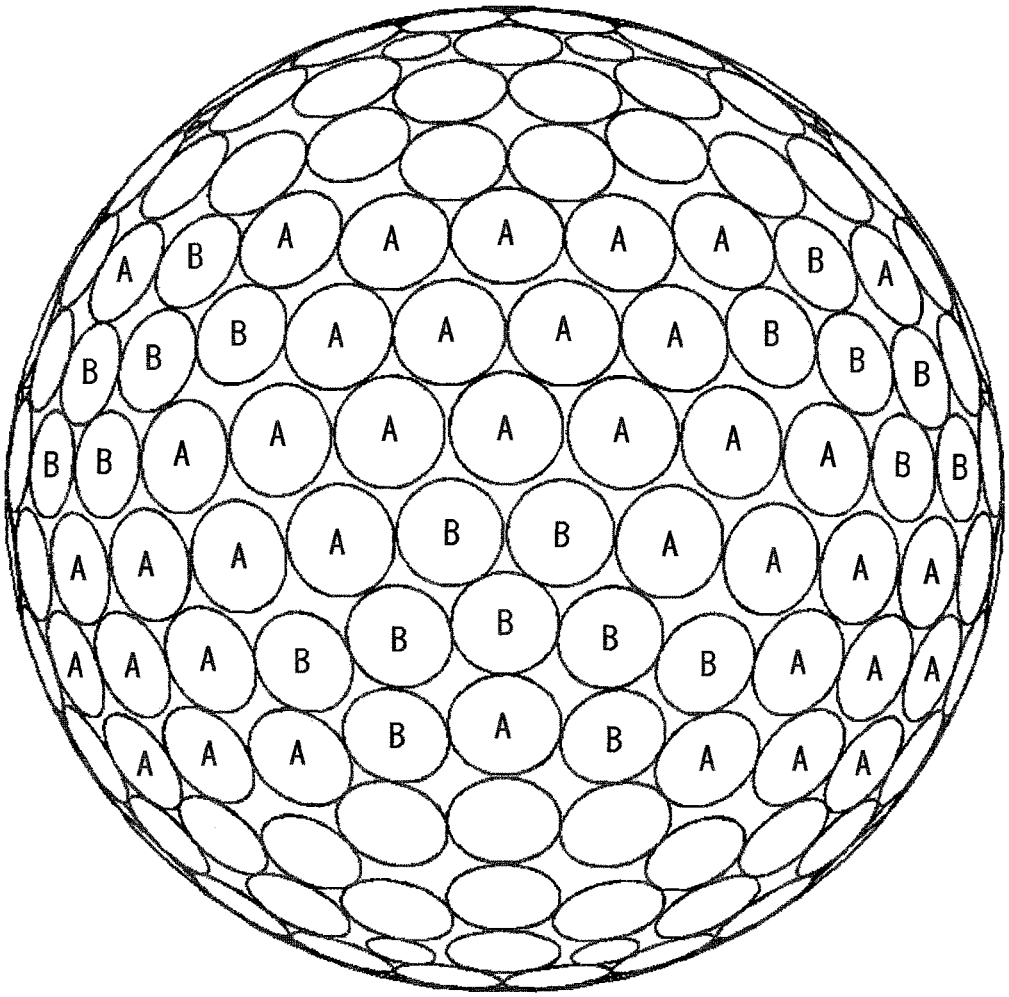
FIG. 11 is a front view of a golf ball according to Example 4 of the present invention.
Figure 12:
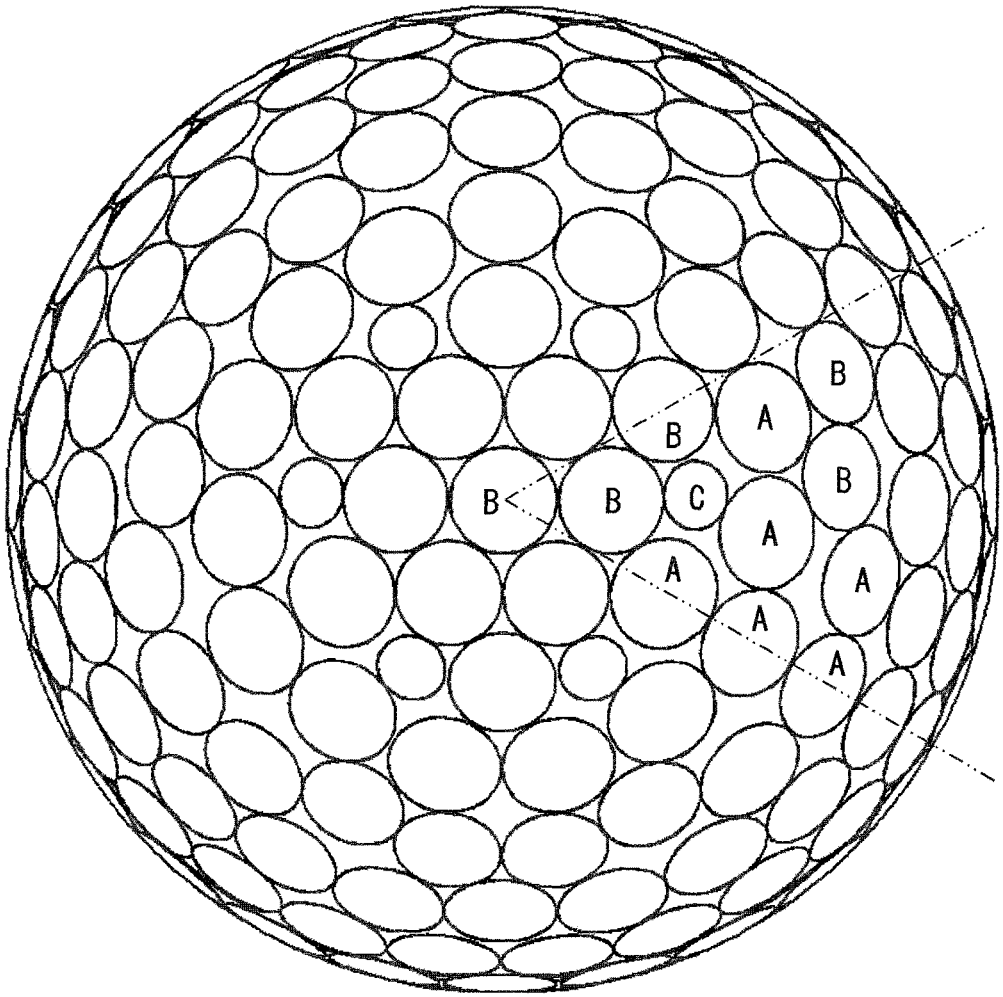
FIG. 12 is a plan view of the golf ball in FIG. 11.
Figure 13:
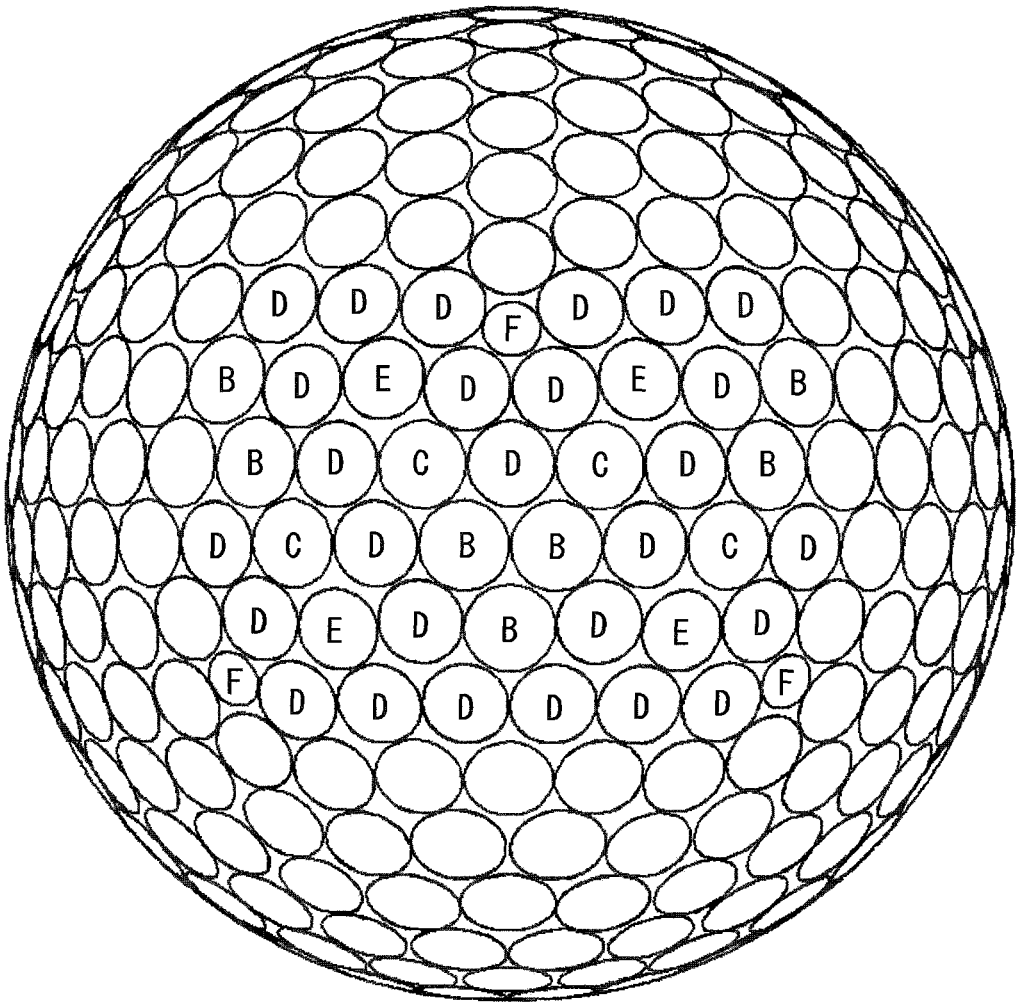
FIG. 13 is a front view of a golf ball according to Example 5 of the present invention.
Figure 14:
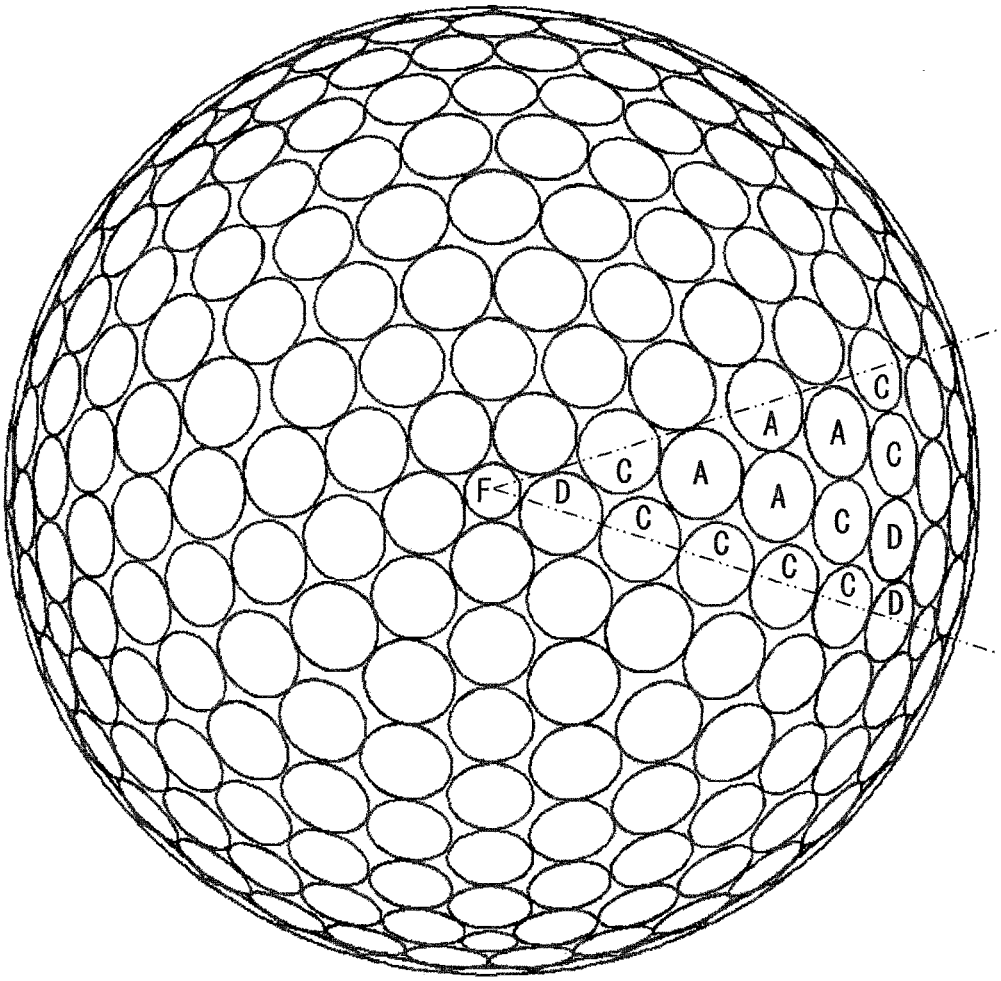
FIG. 14 is a plan view of the golf ball in FIG. 13.
Figure 15:
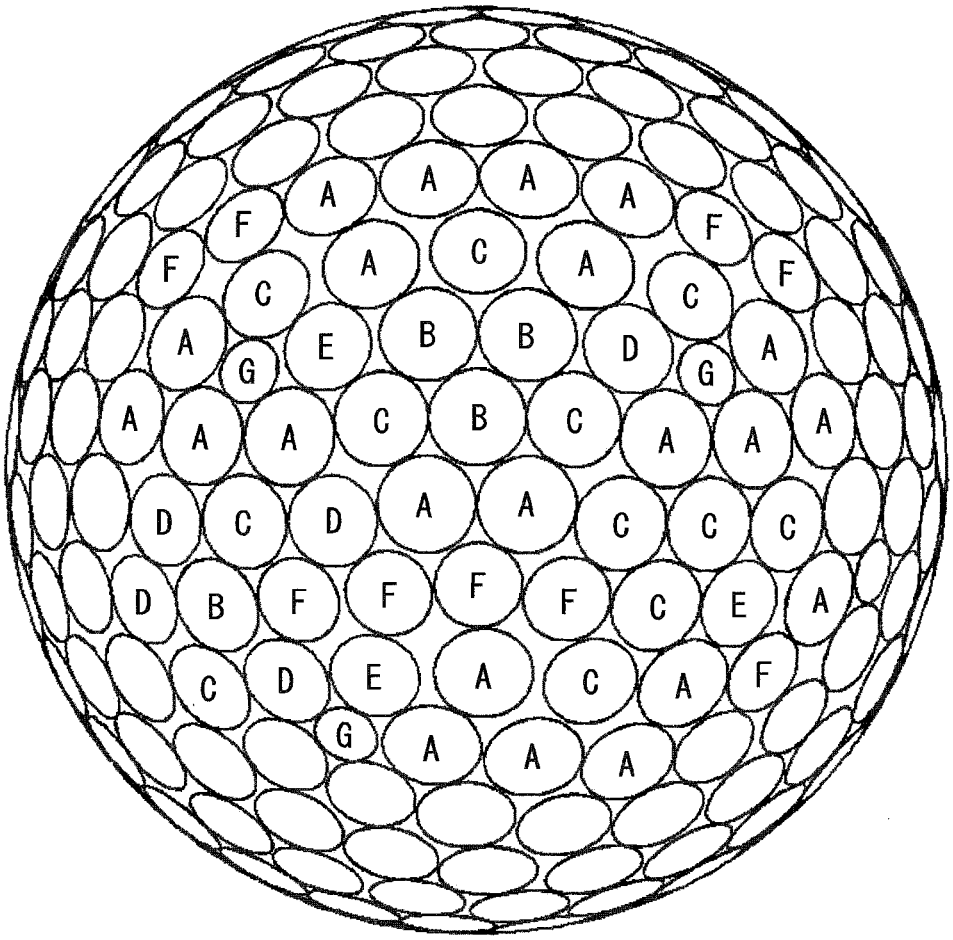
FIG. 15 is a front view of a golf ball according to Example 1 of the present invention.
Figure 16:
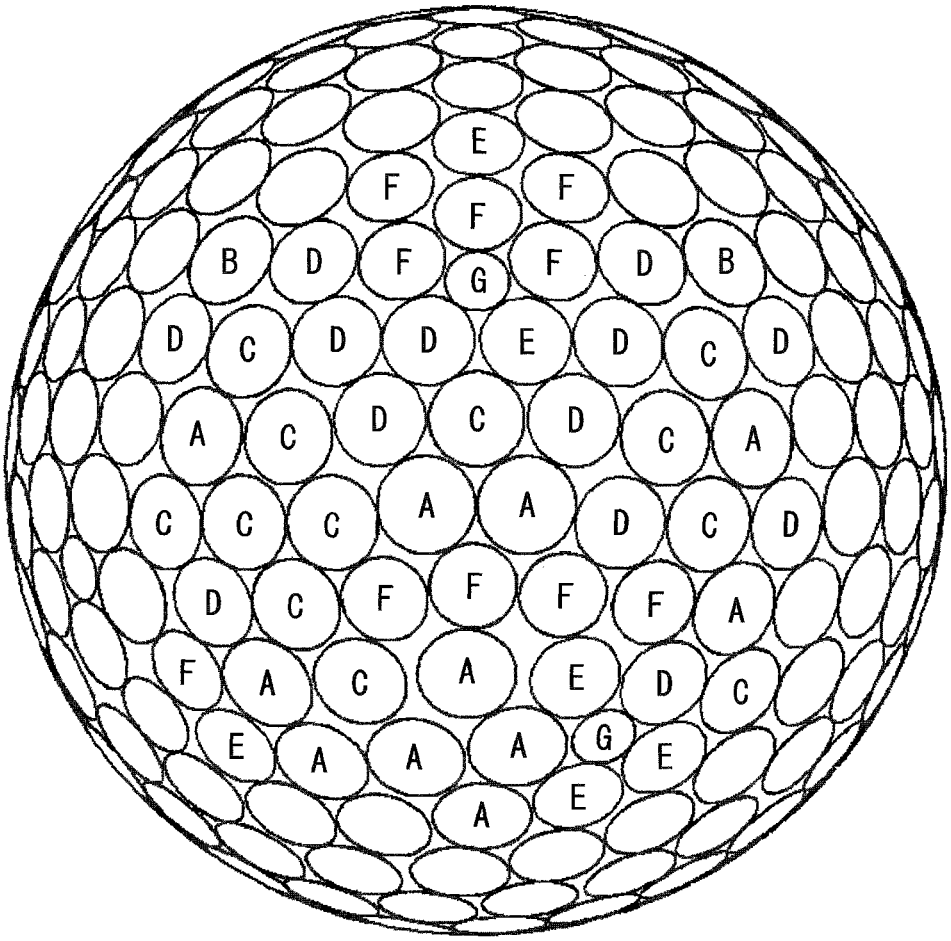
FIG. 16 is a back view of the golf ball in FIG. 15.
Figure 17:
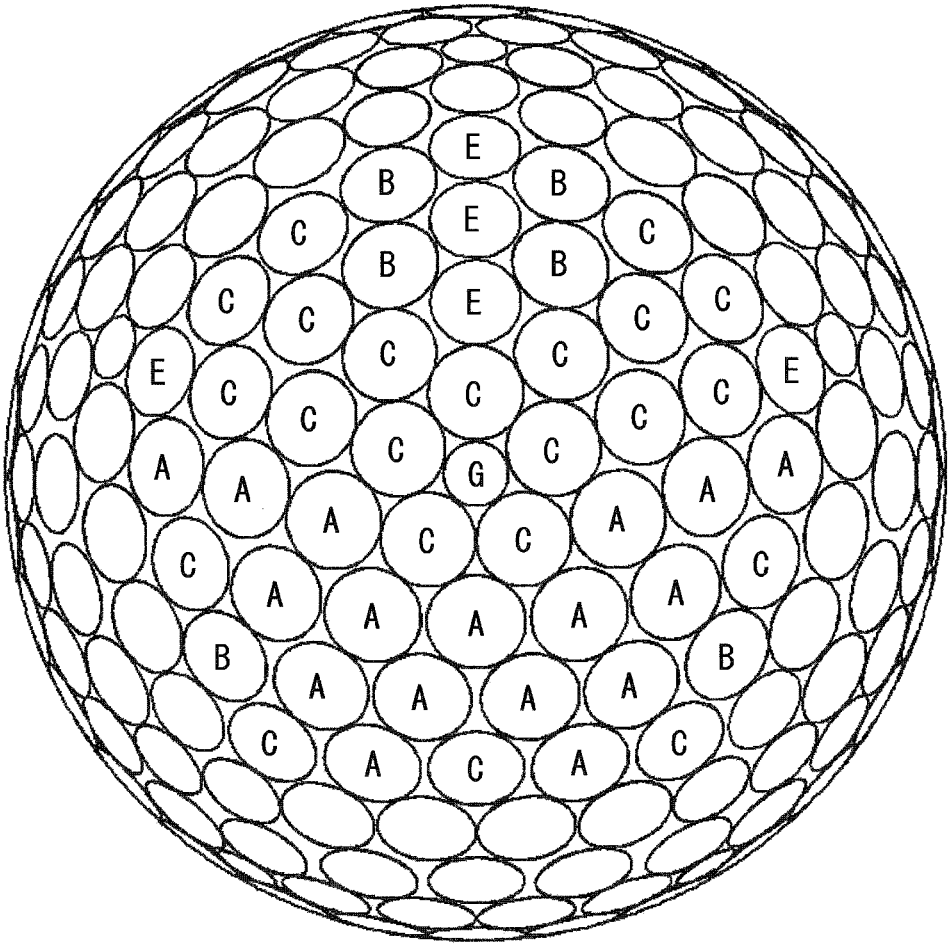
FIG. 17 is a plan view of the golf ball in FIG. 15.
Figure 18:
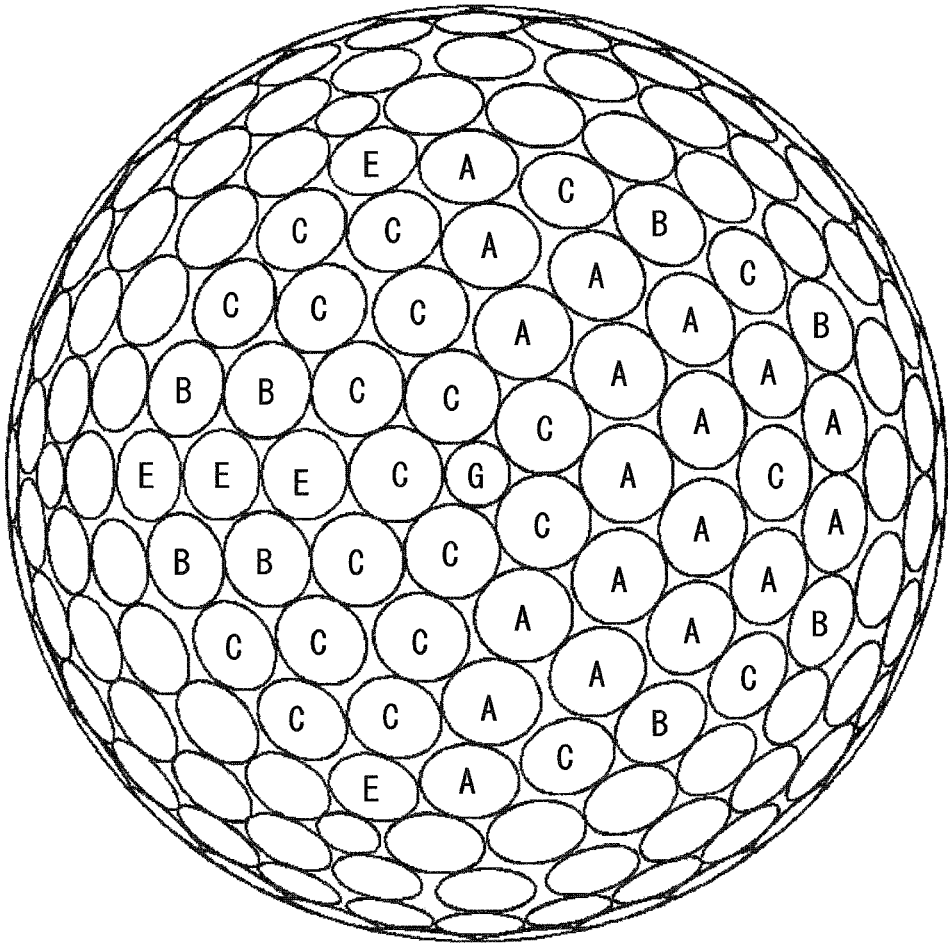
FIG. 18 is a bottom view of the golf ball in FIG. 15.
Figure 19:
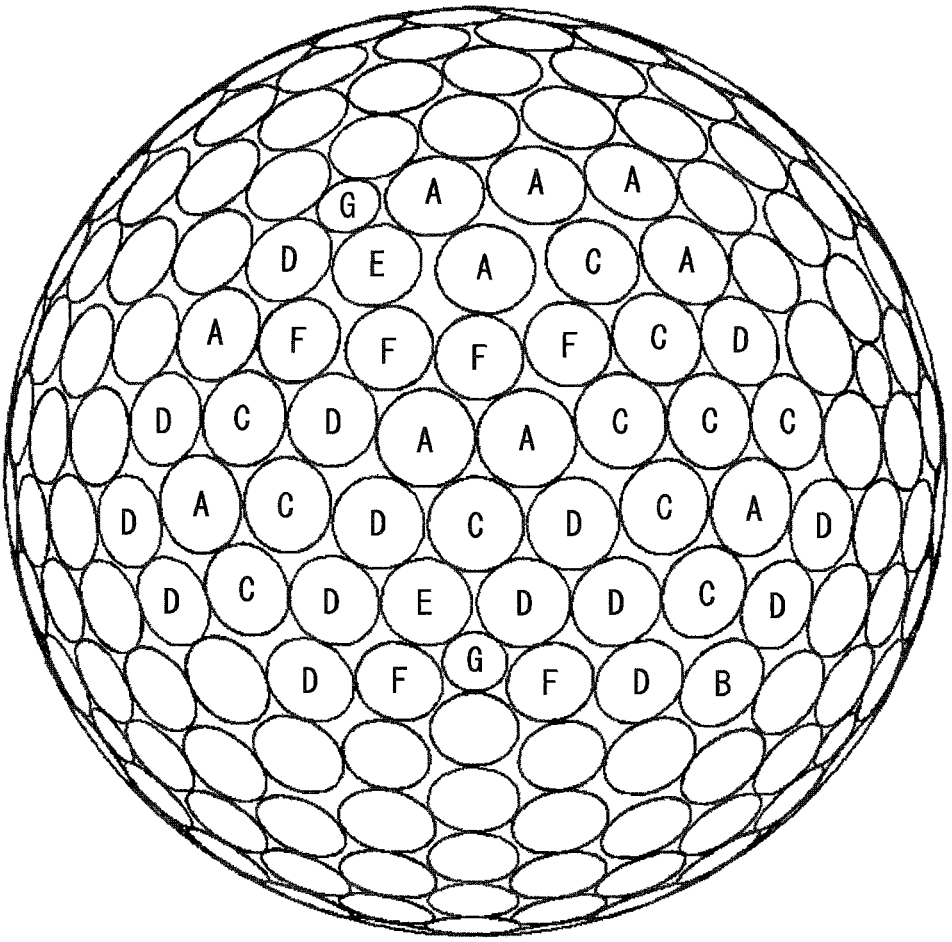
FIG. 19 is a left side view of the golf ball in FIG. 15.
Figure 20:
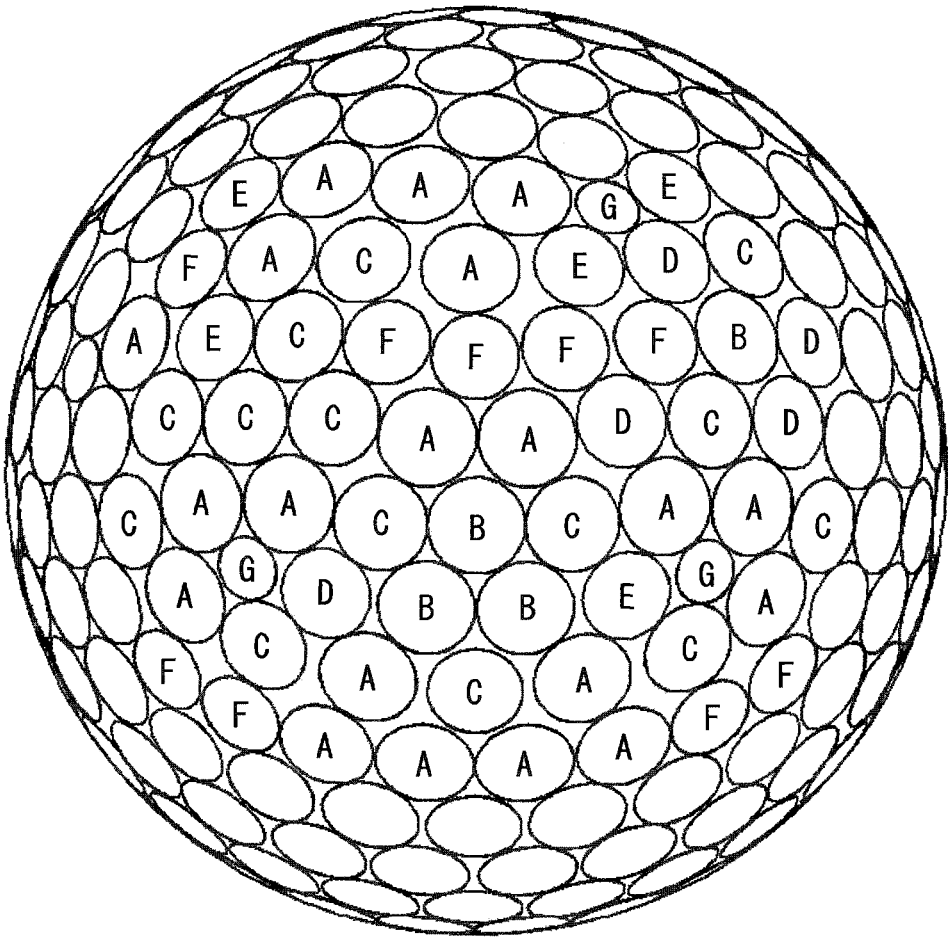
FIG. 20 is a right side view of the golf ball in FIG. 15.

| Results of Evaluation | | | | | |
|---|---|---|---|---|---|
| | Ex. 1 | Ex. 2 | Ex. 3 | Ex. 4 | Ex. 5 |
| Front view | FIG. 15 | FIG. 2 | FIG. 9 | FIG. 11 | FIG. 13 |
| Plan view | FIG. 17 | FIG. 4 | FIG. 10 | FIG. 12 | FIG. 14 |
| Number | 324 | 324 | 338 | 266 | 422 |
| Occupation ratio (%) | 83.9 | 82.3 | 82.0 | 82.1 | 82.6 |
| Total volume ($mm^3$) | 592.9 | 575.8 | 562.3 | 632.2 | 519.8 |
| NS | 12 | 12 | 12 | 12 | 12 |
| NL | 312 | 312 | 326 | 254 | 410 |
| PS (%) | 1.5 | 1.5 | 1.5 | 1.5 | 1.0 |
| G | 1.07 | 0.80 | 0.95 | 0.95 | 0.91 |
| Formula (II) | F. | F. | F. | F. | F. |
| Formula (IV) | F. | F. | F. | N.F. | F. |
| Formula (VI) | N.F. | F. | F. | N.F. | F. |

TABLE 6-continued

| Results of Evaluation | | | | | |
|---|---|---|---|---|---|
| | Ex. 1 | Ex. 2 | Ex. 3 | Ex. 4 | Ex. 5 |
| Flight distance | 261.8 | 262.1 | 263.0 | 261.2 | 261.0 |

F.: fulfilled
N.F.: not fulfilled

TABLE 7

Figure 21:
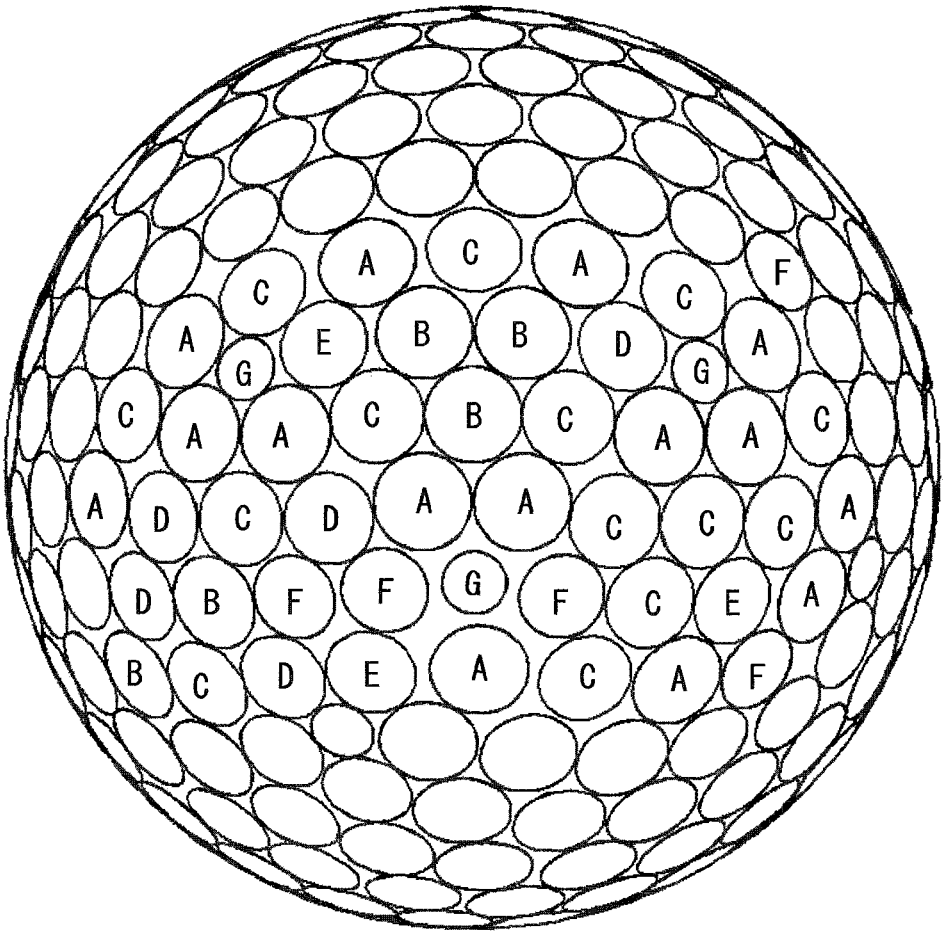
FIG. 21 is a front view of a golf ball according to Example 6 of the present invention.
Figure 22:
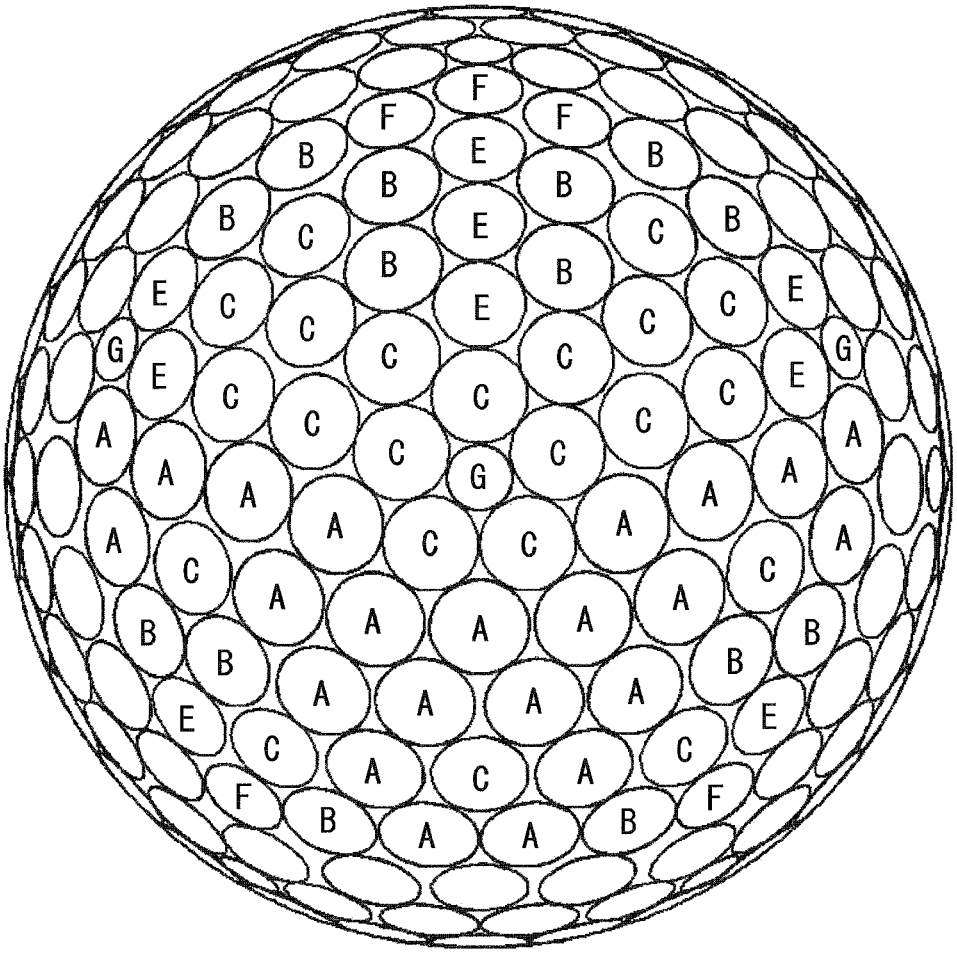
FIG. 22 is a plan view of the golf ball in FIG. 21.
Figure 23:
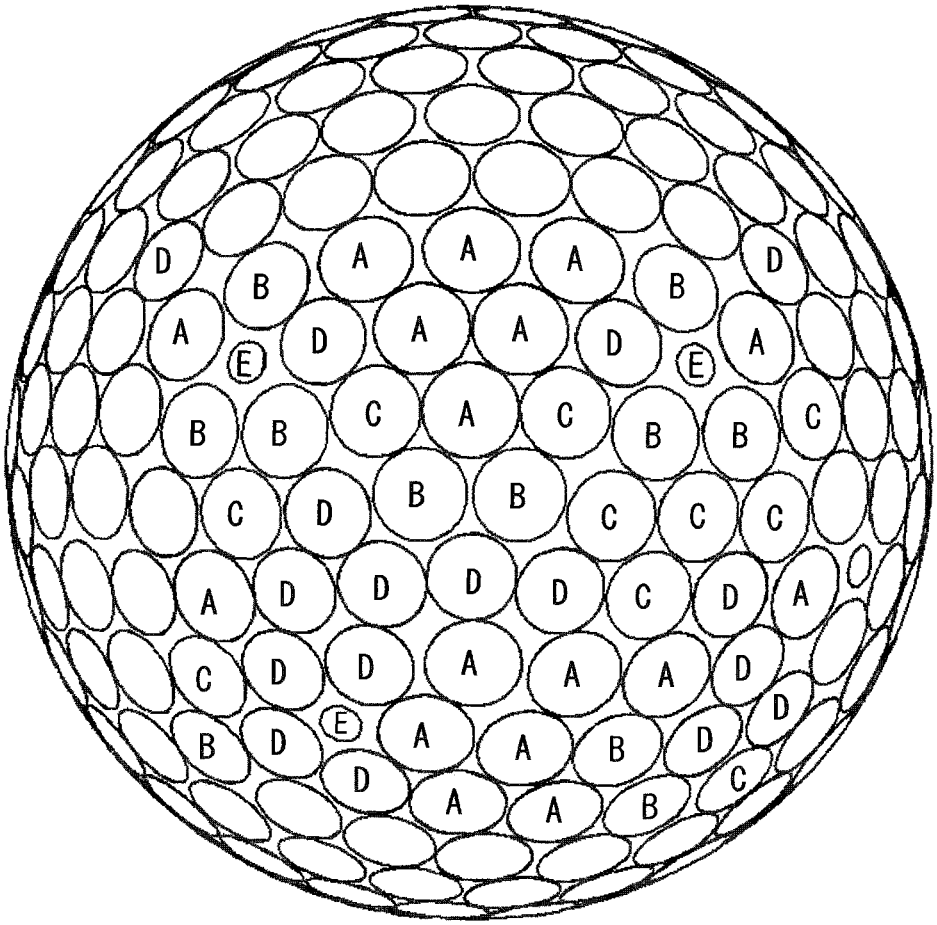
FIG. 23 is a front view of a golf ball according to Example 7 of the present invention.
Figure 24:
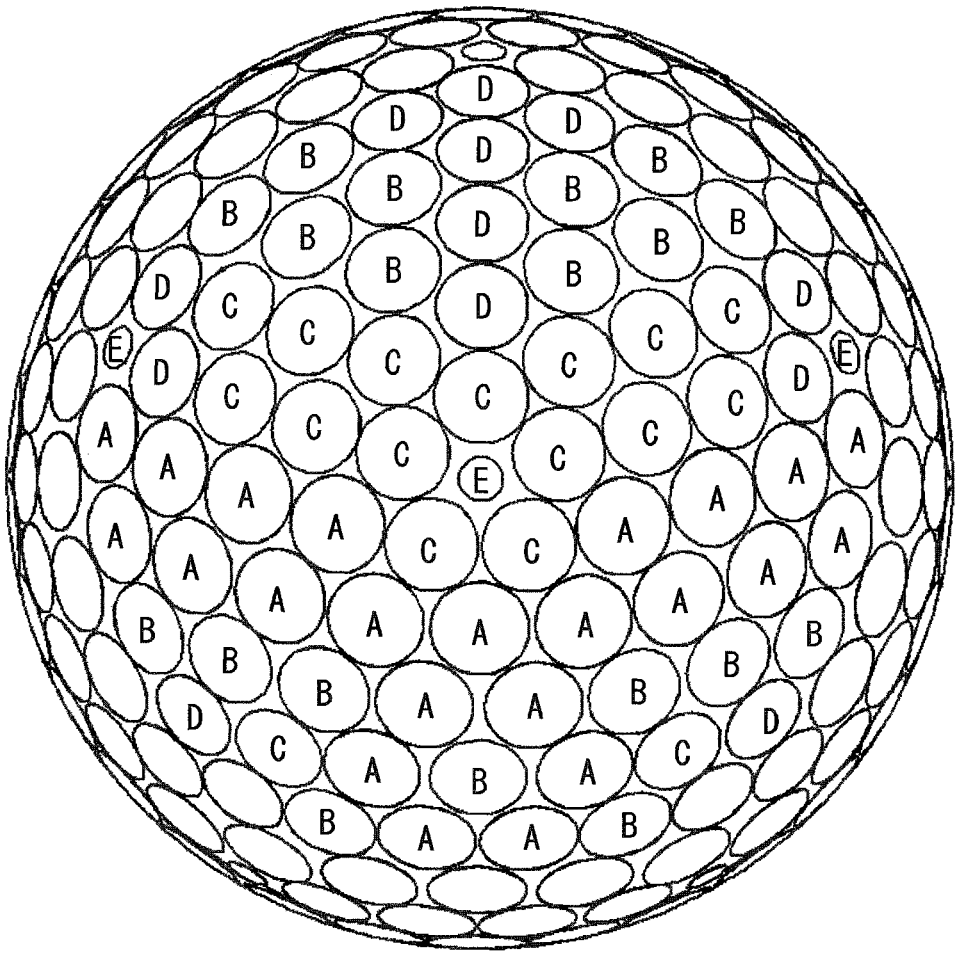
FIG. 24 is a plan view of the golf ball in FIG. 23.

| Results of Evaluation | | | | | |
|---|---|---|---|---|---|
| | Ex. 6 | Ex. 7 | Comp. Ex. 1 | Comp. Ex. 2 | Comp. Ex. 3 |
| Front view | FIG. 21 | FIG. 23 | — | — | — |
| Plan view | FIG. 22 | FIG. 24 | — | — | — |
| Number | 324 | 324 | 333 | 270 | 344 |
| Occupation ratio (%) | 83.8 | 81.5 | 69.6 | 78.8 | 85.3 |
| Total volume ($mm^3$) | 592.0 | 570.9 | 492.1 | 599.0 | 590.1 |
| NS | 14 | 12 | 15 | 12 | 0 |
| NL | 310 | 312 | 318 | 258 | 344 |
| PS (%) | 1.8 | 0.7 | 1.2 | 1.6 | 0.0 |
| G | 1.06 | 0.80 | 1.39 | 2.34 | 1.42 |
| Formula (II) | F. | F. | N.F. | N.F. | N.F. |
| Formula (IV) | F. | F. | N.F. | N.F. | N.F. |
| Formula (VI) | N.F. | F. | N.F. | N.F. | N.F. |
| Flight distance | 261.5 | 261.3 | 257.3 | 256.5 | 260.6 |

F.: fulfilled
N.F.: not fulfilled

TABLE 8

Figure 25:
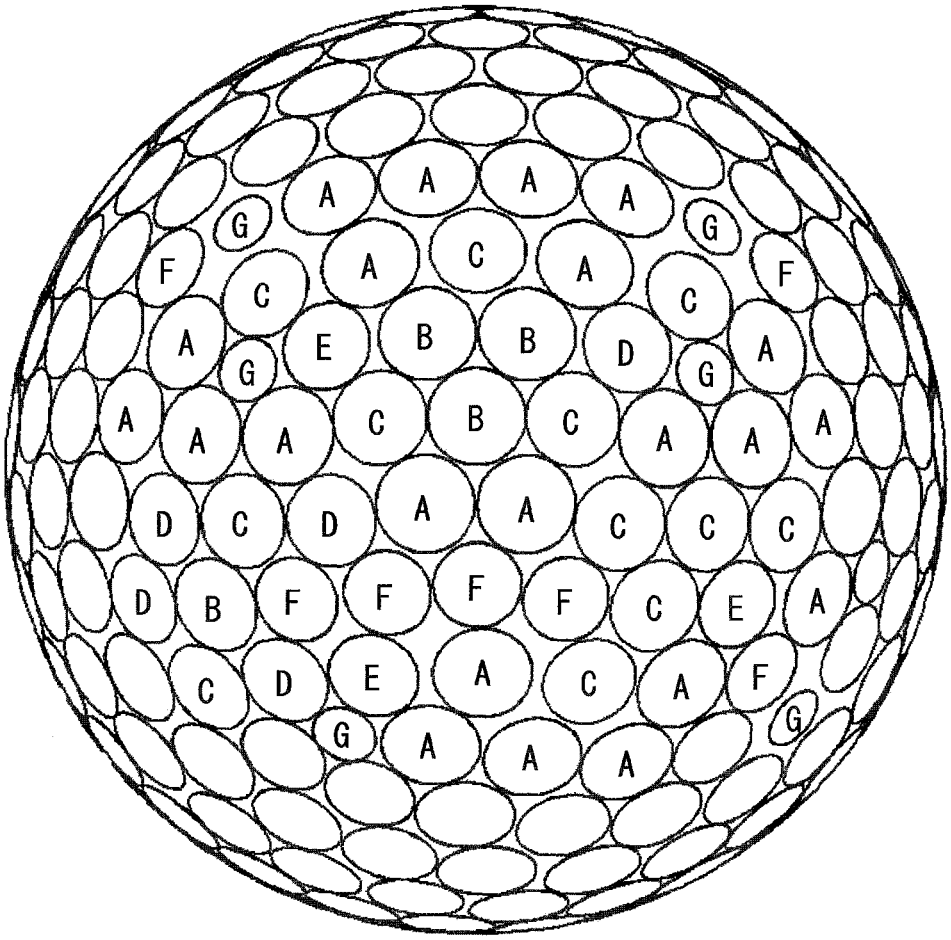
FIG. 25 is a front view of a golf ball according to Comparative Example 7.
Figure 26:
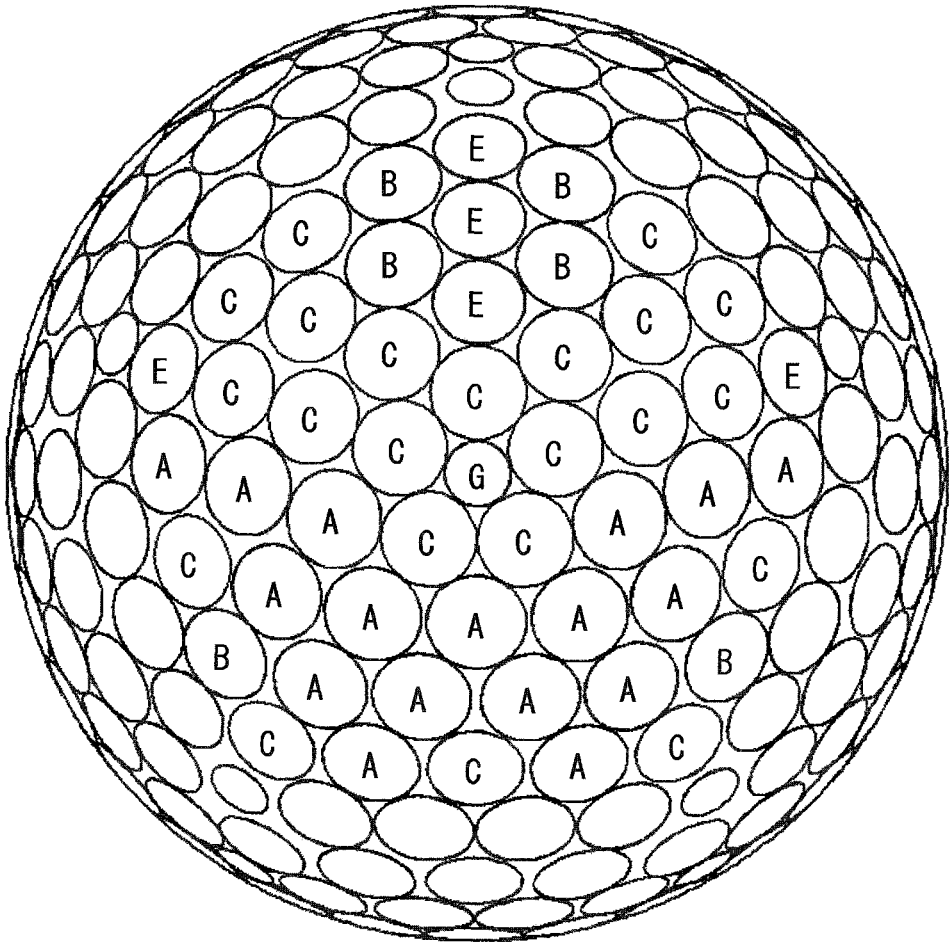
FIG. 26 is a plan view of the golf ball in FIG. 25.
Figure 27:
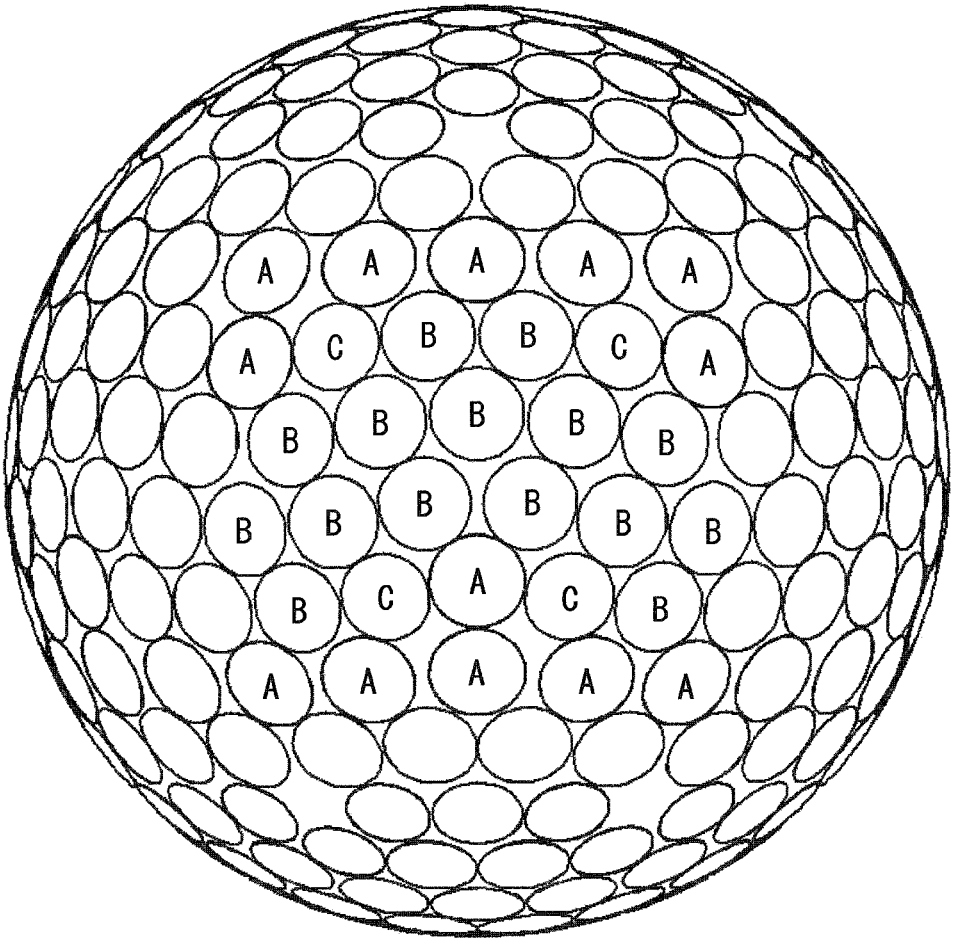
FIG. 27 is a front view of a golf ball according to Comparative Example 8.
Figure 28:
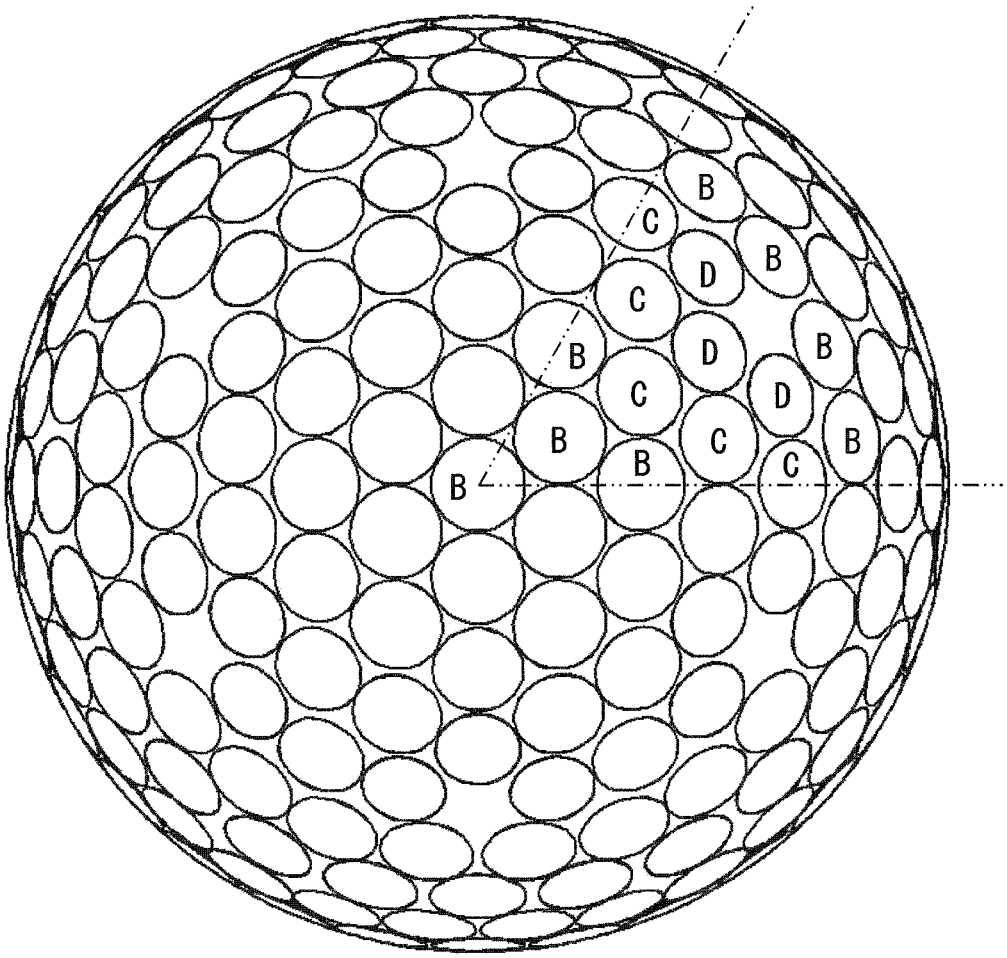
FIG. 28 is a plan view of the golf ball in FIG. 27.

| Results of Evaluation | | | | | |
|---|---|---|---|---|---|
| | Comp. Ex. 4 | Comp. Ex. 5 | Comp. Ex. 6 | Comp. Ex. 7 | Comp. Ex. 8 |
| Front view | — | — | — | FIG. 25 | FIG. 27 |
| Plan view | — | — | — | FIG. 26 | FIG. 28 |
| Number | 372 | 372 | 432 | 324 | 326 |
| Occupation ratio (%) | 78.5 | 84.6 | 79.7 | 83.3 | 80.5 |
| Total volume ($mm^3$) | 519.3 | 552.4 | 492.9 | 587.9 | 554.3 |
| NS | 18 | 18 | 0 | 18 | 0 |
| NL | 354 | 354 | 432 | 306 | 326 |
| PS (%) | 1.4 | 1.6 | 0.0 | 2.2 | 0.0 |
| G | 1.75 | 1.82 | 1.83 | 1.04 | 0.95 |
| Formula (II) | N.F. | N.F. | N.F. | F. | F. |
| Formula (IV) | N.F. | N.F. | N.F. | F. | F. |
| Formula (VI) | N.F. | N.F. | N.F. | F. | F. |
| Flight distance | 258.1 | 257.6 | 257.0 | 260.3 | 259.1 |

F.: fulfilled
N.F.: not fulfilled

As shown in Tables 6 to 8, the golf ball of each Example has excellent flight performance. From the results of evaluation, advantages of the present invention are clear.

The aforementioned dimples are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball having a large number of dimples on a surface thereof, wherein the dimples include a plurality of small dimples each having an area of less than 8.0 $mm^2$, and a plurality of large dimples each having an area of equal to or greater than 8.0 $mm^2$, a ratio PS of a sum of areas of all the small dimples to a surface area of a phantom sphere of the golf ball is less than 2.0%, the number NL of the large dimples is equal to or greater than 250 but less than 450, and the number NL of the large dimples and a degree G of uniformity of areas ($mm^2$) of the large dimples satisfy the following mathematical formula (VI): $G<0.0032 \cdot NL-0.04$ (VI).

2. The golf ball according to claim 1, wherein the ratio 20 PS is equal to or greater than 0.7%.

3. The golf ball according to claim 1, wherein the number NS of the small dimples is equal to or greater than 6 but equal to or less than 20.

4. The golf ball according to claim 1, wherein a ratio (NS/N) of the number NS of the small dimples to a total number N of the dimples is equal to or greater than 0.01 but equal to or less than 0.07.

5. The golf ball according to claim 1, wherein the number NL is equal to or greater than 290 but less than 380.

6. The golf ball according to claim 1, wherein each dimple has a depth of a deepest portion from a surface of the phantom sphere of equal to or greater than 0.10 mm but equal to or less than 0.65 mm.

7. The golf ball according to claim 1, wherein a ratio of a sum of areas of all the dimples to the surface area of the phantom sphere of the golf ball is equal to or greater than 80%.

8. The golf ball according to claim 1, wherein the ratio PS is equal to or less than 1.0% but less than 2.0%.

9. The golf ball according to claim 1, wherein the number NL of the large dimples is equal to or greater than 250 but equal to or less than 380.

10. The golf ball according to claim 1, wherein the degree G is equal to or less than 1.15.

11. A golf ball having a large number of dimples on a surface thereof, wherein the dimples include a plurality of small dimples each having an area of less than 8.0 $mm^2$, and a plurality of large dimples each having an area of equal to or greater than 8.0 $mm^2$, a ratio PS of a sum of areas of all the small dimples to a surface area of a phantom sphere of the golf ball is less than 2.0%, the number NL of the large dimples is equal to or greater than 250 but less than 450, and the number NL of the large dimples and a degree G of uniformity of areas ($mm^2$) of the large dimples satisfy the following mathematical formula (II):

$$G<0.0032-NL+0.26 \quad \text{(II)},$$

wherein a total volume of the dimples is equal to or greater than 450 $mm^3$ but equal to or less than 750 $mm^3$.

* * * * *